US008546301B2

(12) United States Patent
Ribi et al.

(10) Patent No.: US 8,546,301 B2
(45) Date of Patent: Oct. 1, 2013

(54) ON-DEMAND PRINTABLE CONSTRUCT

(75) Inventors: Hans O. Ribi, Hillsborough, CA (US); Chauncey T. Mitchell, Jr., Lakeland, TN (US)

(73) Assignee: WS Packaging Group, Inc., Green Bay, WI (US)

( * ) Notice: Subject to any disclaimer, the term of this patent is extended or adjusted under 35 U.S.C. 154(b) by 216 days.

(21) Appl. No.: 13/158,396

(22) Filed: Jun. 11, 2011

(65) Prior Publication Data

US 2012/0149561 A1 Jun. 14, 2012

Related U.S. Application Data

(60) Provisional application No. 61/354,051, filed on Jun. 11, 2010.

(51) Int. Cl.
*B41M 5/28* (2006.01)
*B41M 5/382* (2006.01)

(52) U.S. Cl.
USPC ..... 503/226; 503/227

(58) Field of Classification Search
None
See application file for complete search history.

(56) References Cited

U.S. PATENT DOCUMENTS

| | | | |
|---|---|---|---|
| 5,685,641 | A | 11/1997 | Ribi |
| 5,918,981 | A | 7/1999 | Ribi |
| 6,543,808 | B1 | 4/2003 | Mitchell, Jr. et al. |
| 7,151,541 | B2 | 12/2006 | Seder |
| 2003/0207066 | A1 | 11/2003 | Killey |

OTHER PUBLICATIONS

RICOH Electronics, Inc.: RECO-View® Product Technical Information (Jun. 11, 2011) http://www.rei.ricoh.com/tc_tech.html, Jul. 2, 2013.
RICOH Electronics, Inc,: RECO-View® Product Specification (May 11, 2011) http://www.rei.ricoh.com/tc_products.html.
Ricoh Electronics, Inc. Product Information Sheet http://vwvw.rei.rocoh.com.

*Primary Examiner* — Bruce H Hess
(74) *Attorney, Agent, or Firm* — Brian B. Shaw, Esq.; Thomas B. Ryan; Harter Secrest & Emery LLP

(57) ABSTRACT

Multi-ply thermally printable constructs include a thermal print medium sandwiched between two opaque substrates that are temporarily bonded together to prevent information that is thermally printed through one of the substrates from being viewed until the substrates are separated. The thermal print medium, opaque substrates, and the means for bonding the substrates can take various forms for achieving particular objectives.

21 Claims, 8 Drawing Sheets

Example 1

MACHINE READABLE ON DEMAND SECURED PRINTING

Example 4

Example 7

ON-DEMAND SECURED DOCUMENT
WITH INVISIBLE SECURITY FEATURE

Example 8

Example 9

Example 11

ON-DEMAND PRINTABLE CONSTRUCT

RELATED APPLICATIONS

This nonprovisional application claims the benefit of U.S. Provisional Application No. 61/354,051 filed on Jun. 11, 2010 whose entire contents are hereby incorporated by reference.

TECHNICAL FIELD

The invention relates to on-demand printable constructs in which printed matter is printed on-demand within the interiors of the constructs generally out of sight from the exterior of the constructs. In particular, the constructs are thermally printable through one of two generally opaque layers between which the printed matter is formed. In many cases, the printed matter is intended to be made accessible to sight by retracting at least part of one of the opaque layers straddling the printed matter.

BACKGROUND OF THE INVENTION

Game pieces known as "pull-tabs" generally contain two layers of paper. The game results are printed on a base layer and are temporarily obscured by a cover layer, which can be at least partially retracted (e.g., peeled away) to reveal the underlying game results.

U.S. Pat. No. 6,543,808 filed in the name of one of the present co-inventors discloses a direct thermal printable pull tab in which a thermally imageable layer is supported on a transparent substrate. An opaque coating or an opaque substrate covers the imageable layer, and an opaque cover substrate covers the transparent substrate. The imageable layer is thermally imageable through the opaque coating or the opaque substrate that covers the imageable layer. The cover substrate is at least partially removable or retractable to reveal the thermal imaging through the transparent substrate.

US Patent Application Publication No. 2003/0207066 to Killey discloses a thermally printed ticket structure in which a base substrate supports a thermal imaging material and a polymeric film containing an obscurant, such as vaporized aluminum, covers the thermal imaging material. An adhesive layer bonds the polymeric film to the base substrate, but a portion of the adhesive layer is covered by a release coating that allows the polymeric film to be retracted from the base substrate. Thermal images are formed in the thermal imaging material through the polymeric film. At least one area of the polymeric film overlying the release coating is retractable from the base substrate to reveal the thermal images.

We have found thermal printing through intervening layers to be problematic, particularly through layers of ink or adhesive layers in combination with opaque substrates. High concentrations of heat associated with thermal printing can leave trace images of the otherwise hidden printed matter on the surfaces of the obscuring layers, particularly where obscuring inks are used to hide the printed matter. Where opaque substrates are used, adhesive layers that bind the substrates together can interfere with the required transmissions of heat to the thermally printable medium or react adversely with the thermally printable medium, limiting the effectiveness or shelf life of the print medium. The high concentrations of heat required to effectively penetrate the opaque substrate and adhesive layers can also leave trace images of the printing on exposed portions of the constructs.

SUMMARY OF THE INVENTION

The invention, as set forth by example in a preferred form, features an on-demand printable construct fashioned from two substrates straddling a thermally printable medium. For most applications, both substrates are preferably opaque either as a characteristic of the substrates themselves or as an addition to the substrates, e.g., a coating. The thermally printable medium can take a variety of forms including thermochromic and transfer/sublimation mediums. The thermally printable medium is thermally printable through one of the substrates (i.e., a thermally transmissive substrate), preferably by use of a conventional thermal printer at normal settings. An adhesive or other bonding agent secures the substrates together, particularly for purposes of blocking visual access to any thermally printed material produced by controlled transfers of heat through one of the substrates. However, the adhesive is preferably excluded from overlapping with areas of the thermally printable medium intended primarily for thermal printing. Arrangements are also preferably made for retracting the thermally transmissive substrate in a manner that evidences its retraction for revealing the thermally printed material otherwise hidden between the substrates.

Excluding adhesive from positions of overlap with areas of the thermally printable medium intended primarily for thermal printing eliminates the adhesive as a part of a thermally conductive pathway between the thermal printer and the printable areas of thermally printable medium and prevents exposure of the printable areas of the thermal printable medium to adverse chemical reactions with the adhesive. Preferably, the thermally printable medium, as a transfer/sublimation medium, is mounted directly on the thermally transmissive substrate or, as a thermochromic medium, is substantially contiguous with the thermally transmissive substrate and in substantial contact with the thermally transmissive substrate during thermal printing. The arrangements provide for more efficient transfers of energy between the thermal printer and the thermally printable medium. Elimination of the adhesive as an intervening layer also prevents adverse reactions between the adhesive the thermally printable medium that could reduce the printing quality or shelf life of the thermally printable medium.

The invention among its embodiments features transfer/sublimation mediums that can be applied directly to a back (internally facing) surface of the thermally transmissive substrate. The transfer/sublimation mediums can themselves act as obscuring agents but more importantly provide for transferring under the influence of heat generated by a thermal print head corresponding patterns of inks or dyes to an apposing accepting surface, such as the front (internally facing) surface of the other substrate. In general, the transfer/sublimation mediums rapidly change in phase (e.g., melt) in response to the application of heat generated by thermal printers. The locally transitioned medium in a liquid or gaseous state contacts, permeates, and attaches to the accepting surface to form on the accepting surface printed matter such as text or graphics. Heat from the thermal printer is only required to transmit through the thermally transmissive substrate to reach the transfer/sublimation medium. Once transitioned by heat, the transfer/sublimation medium releases inks or dyes that are drawn to the apposing surface on which the inks or dyes are captured.

We have identified Carnauba wax as a particularly effective transfer vehicle for initially entrapping the inks or dyes within a solid emulsion but transitioning under the influence of heat for releasing the inks or dyes in a liquid or gaseous state for transfer to the apposing surface. Carnauba wax is known an organic material exhibiting hypoallergenic and emollient properties. As a transfer agent, the Carnauba wax, which can be arranged with a melting transition temperature matched to the output temperature of conventional thermal printers, adds shine or gloss to the transferred ink or dyes.

The invention also envisions use of water-based polymeric inks that avoid hazardous emissions associated with solvent-based inks. The polymeric inks can be produced in a monomeric or pre-polymerized form and the degree of polymerization can be adjusted to control the temperature of an expected color change.

The thermally printable medium can include alone or in combination with conventional inks a number of specialty inks or other visually engaging elements for extending the functionality of the constructs, such as for purposes of entertainment, promotion, or security. The formulation of the thermally printable medium can for example include components that optically respond to particular forms of energy, such as heat or cold, infrared or ultraviolet light, or pressure, or respond to environmental factors such as air, oils, or water. For example, reversible or irreversible thermochromic inks can be used alone or in combination with other inks of a fixed color or other optical characteristic. Invisible dyes, fluorescent dyes, photochromic dyes, and metal flakes are among other examples of inks or ink additives that can be used alone or in combination with other inks or ink additives to achieve desired optical effects, including effects responsive to the application of particular forms of energy or changes in ambient conditions, such as changes in temperature or the application of an actinic radiation.

The extended functionality provided within the thermally printable medium can provide an enhanced interactive response with an intended user. For example, after retracting all or a portion of the thermally transmissive substrate for revealing printed matter produced from the thermally printable medium, the user can initiate a further color change by application of some form of light, heat, or pressure or by exposure to some environmental element such as water. A color change or other optical response could also be arranged within the thermally printable medium to occur in stages or to occur differently in response to different stimuli. Alternatively, some form of user action may be required to form a visible image from the printed form of the thermally printable medium.

In addition to formulating the thermally printable medium to produce compound effects, different formulations of the thermally printable medium can be used together within individual constructs. For example, different thermal medium formulations can be laid down in adjacent patches with lateral, longitudinal, or even radial offsets so that different portions of the printed constructs provide different optical effects.

Non-transferable thermally printable mediums such as direct thermal printable mediums can also be used particularly as a coating applied to the interior surface of one the apposing substrates. Even if coated on the substrate arranged next to the thermally transmissive substrate through with printing energy is applied, no thermally obstructing layers are preferably assembled between the thermally transmissive substrate and the direct thermal printable coating. Any adhesive for bonding the substrates together is preferably located apart from any area of the direct thermal printable coating intended primarily for printing.

Applications include, but are not limited to pull tabs for the gaming industry, pull tabs for promotional products and applications, hidden encoded or print on demand applications for product inserts and surprise packaging components, document printing, label printing, coupons for retail stores, gaming coupons for quick service restaurants, promotional coupons, instructional information, publishing, awards, test scores, State lottery tickets, direct thermal pull tab tickets, gaming applications, on-demand printed packing lists, concealed informational products, promotional products, promotional labels, tickets for entertainment, password security, credit card security, embedded lists, numerical codes, user identification numbers, passwords, governmental security applications, secret messaging, package contents, visual learning tools, educational applications, internet user numbers, computer security codes, purchase codes, redeemable tickets, sporting tickets, event tickets, movie tickets, auto and product purchase codes, process validation, census codes, bar coding, factory information and factory codes to be retrieved at later date, obscured and encoding born-on-dates and use-by-dates, licenses of a number of types, new thermal transfer/sublimation dye systems, novel transfer printing films and papers, art papers and films, thermochromic print-ready graphic transfer mediums, interactive security tickets, multi-level security informational documents, multi-element interactive coupons and tickets, interactive pull tabs with transferred color change capabilities, on-demand metallized embossing, time indicating sensors, time-temperature indicating sensors, magnetic recording substrates, electrical inductive substrates, RFID interactive constructs, time initiation sensors, time-temperature initiation sensors, chemi-luminescent reaction initiation devices, electrical conducting circuits, personalized functional kiosk printed articles, multi-element multi-functional applications, and the like.

BRIEF DESCRIPTION OF THE DRAWING FIGURES

Figure 10A:
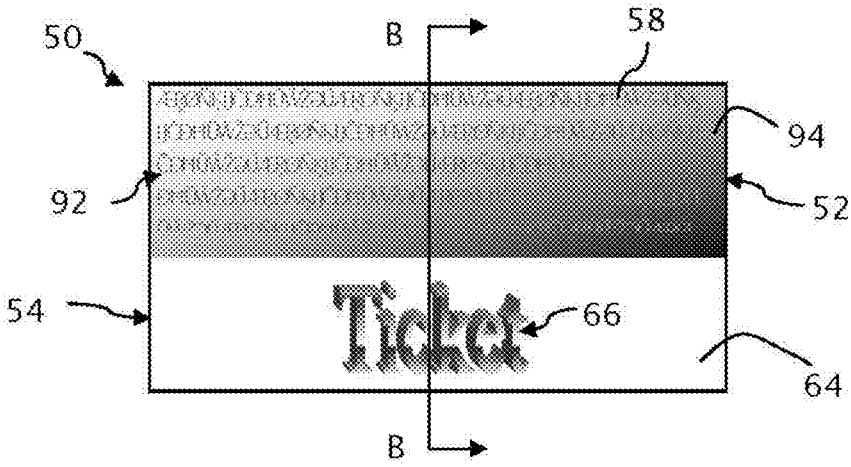
Figure 10B:
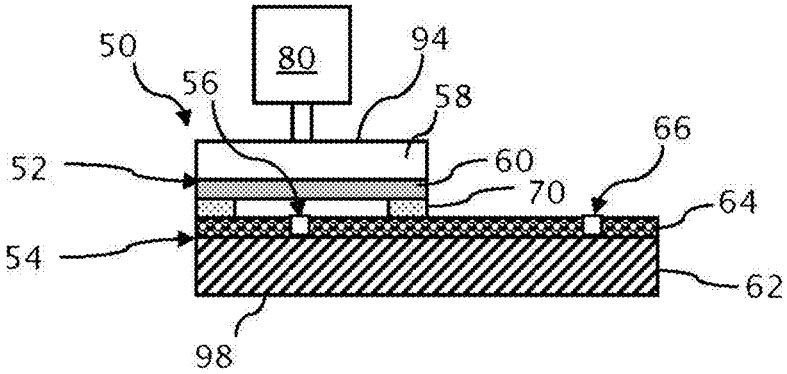
Figure 10C:
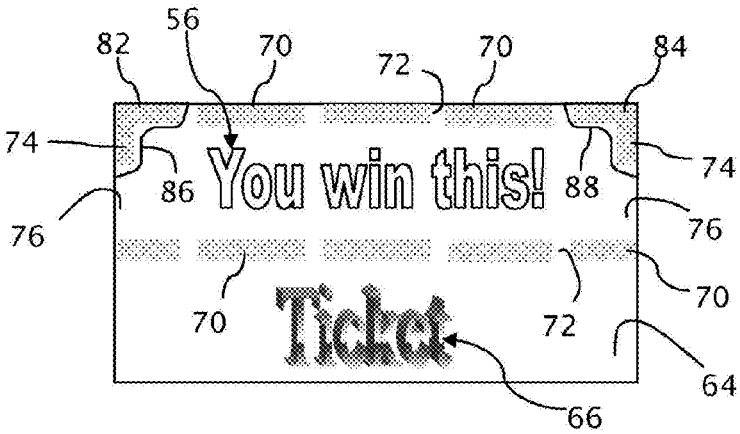
Figure 10D:
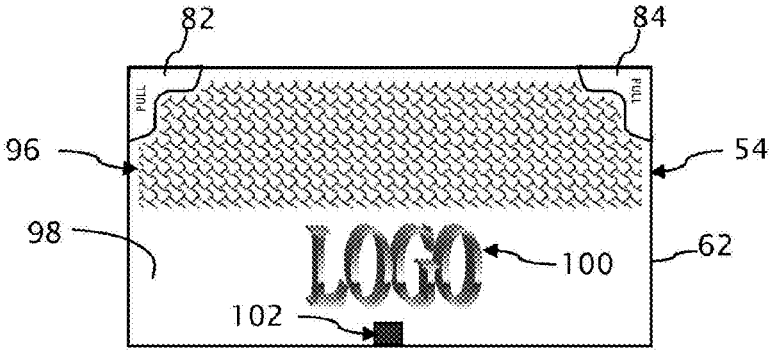
Figure 10E:
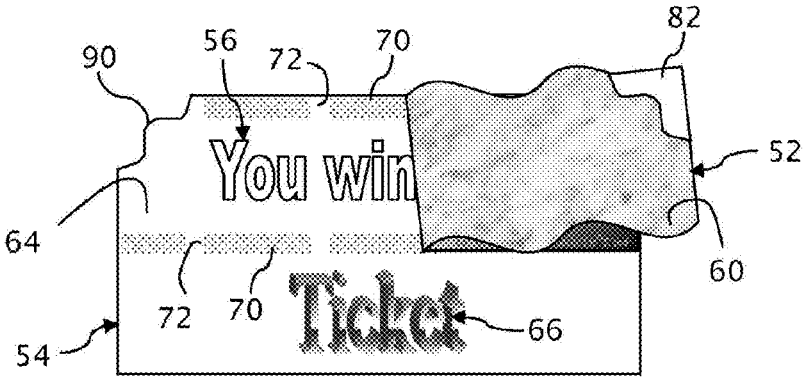

FIGS. 10A-E depict a two-ply on-demand printable construct in accordance with the invention with a front view of the construct provided by FIG. 10A, a cross-sectional view along line B-B of FIG. 10A provided by FIG. 10B, a front view with a top ply removed provided by FIG. 10C, a back view provided by FIG. 10D, and a front view with the top ply partially retracted provided by FIG. 10E.

Figure 11:
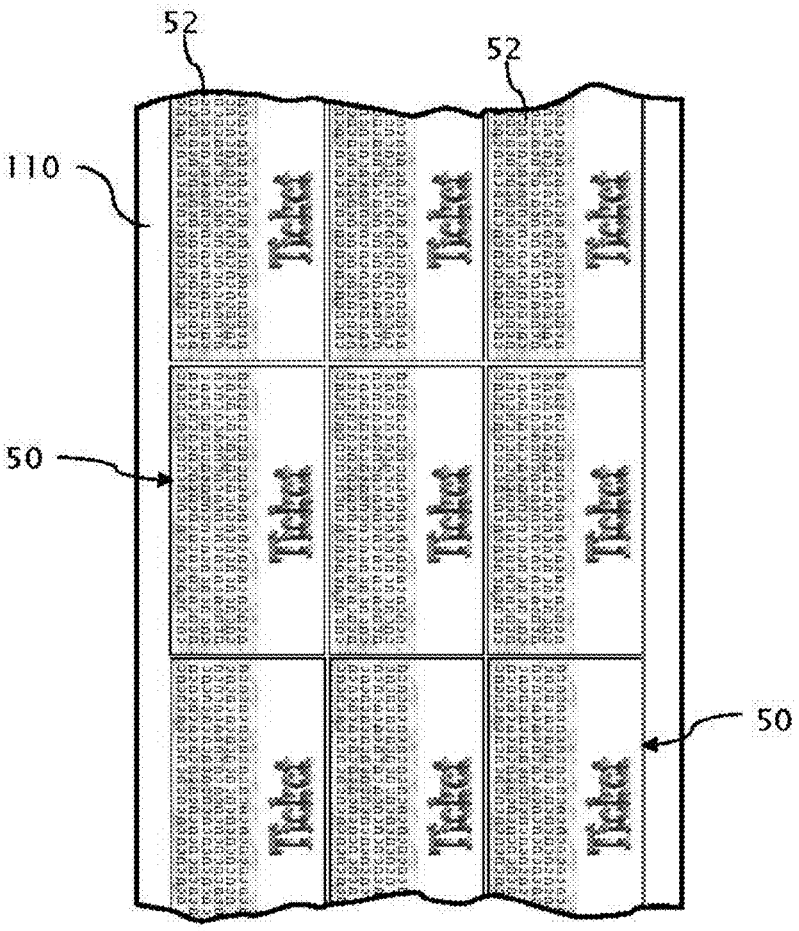

FIG. 11 depicts a front view of a cut-away length of a web on which successions of the construct shown in FIGS. 10A-E are arranged three wide.

Figure 12:
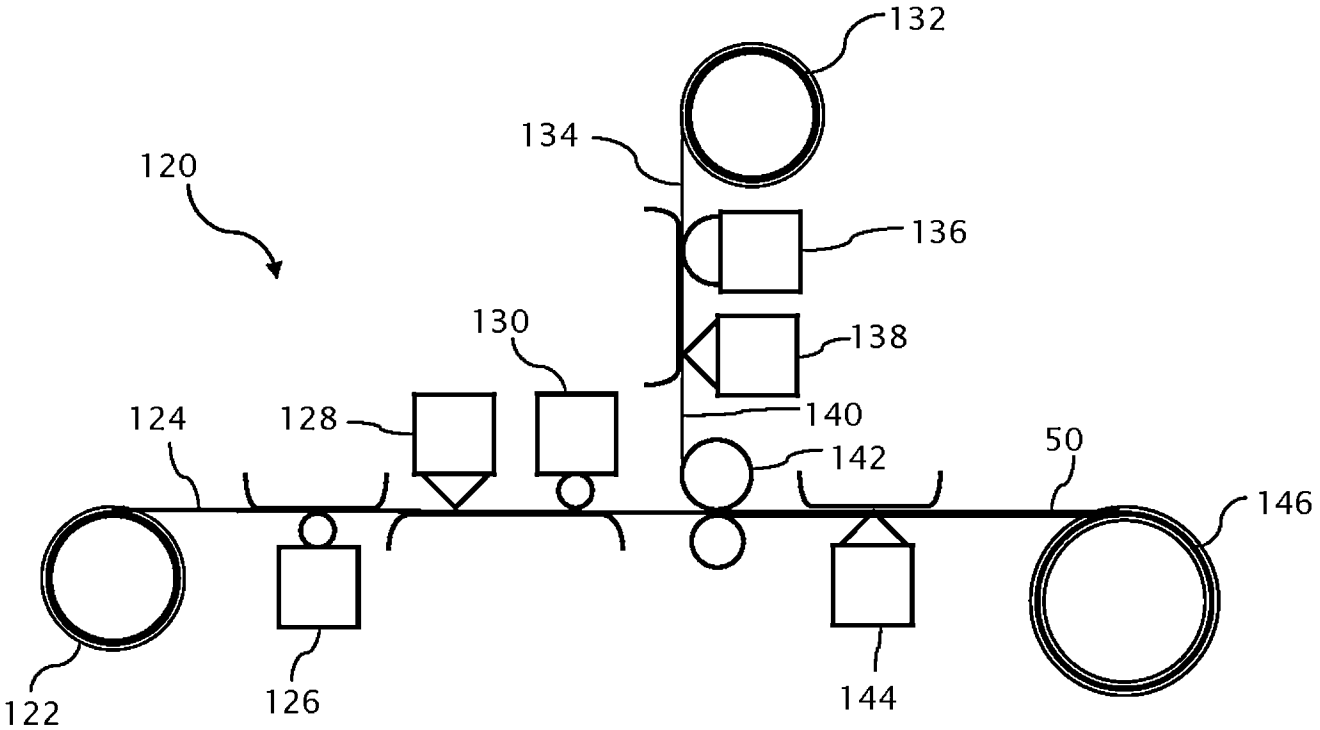

FIG. 12 depicts an in-line press in schematic form for forming successions of the constructs of FIGS. 10A-E such as shown in the web of FIG. 11.

Figure 13:
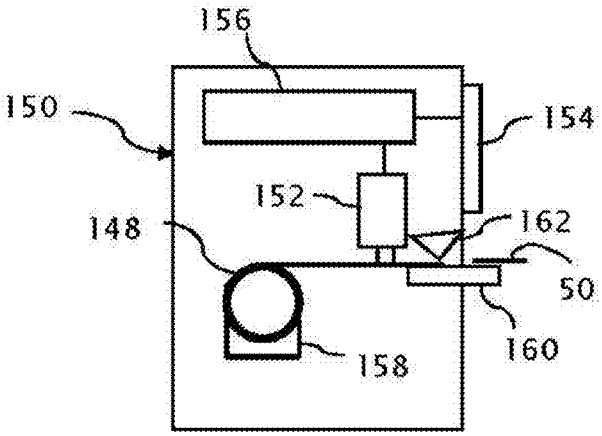

FIG. 13 depicts an interactive on-demand thermal print system for printing and dispensing the constructs of FIGS. 10A-E.

DETAILED DESCRIPTION OF THE INVENTION

A description of certain components drawn upon in various combinations in support of various embodiment of the invention are described under separate headings.

Opaque/Obscuring Layers and Films

Opaque/obscuring layers and films find defined use to block the visual display of any secured on-demand printed information. A range of solid opaque, printed opaque, metallized opaque, dielectric, reflective coated, cross-polarized or other visually obscuring films or layers can be utilized. Importantly, the opaque/obscuring layer or film should also provide for rapid and direct thermal transfer with limited lateral energy diffusion to enable activation or transfer of an optical printed layer on the back side of the opaque layer or on an immediately contacting lower substrate layer.

Highly opaque films find significant use in obscuring securely printed materials and information. Films of interest can be made opaque using printing process whereby darkly color, dyed or pigmented inks can be coated on the film surface, films can be made opaque using co-extruded dyes, tinting, cross polarization, scattered imaging, pigments, and agents that are specialized in blocking light such as nanoparticles and dispersed micro-spheres. Laminated opaque films can be utilized where a highly opaque films is laminated to a secondary substrate.

Particularly effective for certain purposes of the invention are metallized polymer and plastic films. Metallized films are polymer films coated with a thin layer of metal, usually aluminum. They offer the glossy metallic appearance of an aluminum foil at a reduced weight and cost. Metallized films are widely used for decorative purposes and food packaging, and also for specialty applications including insulation and electronics.

Metallization can be utilized to form highly opaque yet very thin layers. Likewise, in the case of direct thermal process for printing secured on-demand information, metal layers have the advantage of assisting to maintain good thermal conductivity between the thermal print heads on the printing unit and interleaving layers until the thermal energy reaches a thermally responsive ink that changes color state in response to printing.

As aluminum foil acts as a complete barrier to light and oxygen (which cause fats to oxidize or become rancid), odors and flavors, moisture, and bacteria, it is used extensively in food and pharmaceutical packaging. Aluminum foil is used to make long-life packs (aseptic packaging) for drinks and dairy products, which enables storage without refrigeration. Aluminum foil laminates are also used to package many other oxygen or moisture sensitive foods, and tobacco, in the form of pouches, sachets and tubes, and as tamper evident closures. Aluminum foil containers and trays are used to bake pies and to pack takeaway meals, ready snacks and long-life pet foods.

Biaxially-oriented polyethylene terephthalate (boPET) is a polyester film made from stretched polyethylene terephthalate (PET) and is used for its high tensile strength, chemical and dimensional stability, transparency, reflectivity, gas and aroma barrier properties and electrical insulation. A variety of companies manufacture boPET and other polyester films under different trade names. In the US and Britain, the most well-known trade names are Mylar, Melinex and Hostaphan.

Biaxially oriented PET film can be metallized by vapor deposition of a thin film of evaporated aluminum, gold, or other metal onto it. The result is much less permeable to gases (important in food packaging) and reflects up to 99% of light, including much of the infrared spectrum. For some applications like food packaging, the aluminized boPET film can be laminated with a layer of polyethylene, which provides sealability and improves puncture resistance. The polyethylene side of such a laminate appears dull and the PET side shiny.

Other coatings, such as conductive indium tin oxide (ITO), can be applied to boPET film by sputter deposition. Metallized nylon (or "foil") balloons used for floral arrangements and parties are often mistakenly called "Mylar", one of the trade names for boPET film.

Metallized films can be prepared using sputtering. Sputtering is used extensively in the semiconductor industry to deposit thin films of various materials in integrated circuit processing. Thin antireflection coatings on glass for optical applications are also deposited by sputtering. Because of the low substrate temperatures used, sputtering is an ideal method to deposit contact metals for thin-film transistors. Perhaps the most familiar products of sputtering are low-emissivity coatings on glass, used in double-pane window assemblies. The coating is a multilayer containing silver and metal oxides such as zinc oxide, tin oxide, or titanium dioxide. Sputtering is also used to metallize plastics such as potato chip bags. A large industry has developed around tool bit coating using sputtered nitrides, such as titanium nitride, creating the familiar gold colored hard coat. Sputtering is also used as the process to deposit the metal (e.g. aluminum) layer during the fabrication of CD and DVD discs.

Physical vapor deposition (PVD) is a form of vacuum deposition and is a general term used to describe any of a variety of methods to deposit thin films by the condensation of a vaporized form of the material onto various surfaces (e.g., onto semiconductor wafers). The coating method involves purely physical processes such as high temperature vacuum evaporation or plasma sputter bombardment rather than involving a chemical reaction at the surface to be coated as in chemical vapor deposition. The term physical vapor deposition appears originally in the 1966 book Vapor Deposition by C F Powell, J H Oxley and J M Blocher Jr., but Michael Faraday has been recognized as using PVD to deposit coatings as far back as 1838.

Variants of PVD of interest include but are not limited to various processes in which the material to be deposited is heated to a high vapor pressure by electrically resistive heating in "low" vacuum. Electron beam physical vapor deposition involves heating the target material to be deposited to a high vapor pressure by electron bombardment in "high" vacuum. Sputter deposition involves a glow plasma discharge (usually localized around the target material by a magnet) that bombards the target material, sputtering some away as a vapor. Cathodic Arc Deposition involves a high-power arc directed at the target material, which blasts away some of the target material into a vapor. Pulsed laser deposition involves a high-power laser that ablates material from the target into a vapor.

PVD is used in the manufacture of items including semiconductor devices, aluminized PET film for balloons and snack bags, and coated cutting tools for metalworking. Besides PVD tools, special smaller tools have been developed mainly for scientific purposes. They mainly serve the purpose of extremely thin films measured in atomic layers and are used mostly for small substrates. Mini e-beam evaporators, for example, can deposit monolayers of virtually all materials with melting points up to 3500° C.

Metallized and other highly opaque and thin films provide a combination of high opacity, facile thermal diffusion and conductivity between the print heads and printable medium, affordability and commercial availability, ability to be further printed for informational purposes, and ease of use in high speed automated printing and manufacturing processes.

Metallized films can include but are not limited to vapor deposited films, sputtered films, metal coated films, pure cast or formed foil films, printed metal films, embossed or laminated metal films and the like. The metal layer can range in practical thickness depending on the printers capabilities. High energy printers can accommodate thicker films and metal layer where as lower energy print units will only be able to accommodate thin films with good thermal transfer properties.

Metallized layers coated on plastic resin-based films can range from over 100 microns to a few molecular layers of metal depending on the required parameters for printing and product constructs. Usually, metallized layers will range between 50 microns and 0.5 nanometers. More often metal layers will range 10 microns to 1 nanometer. Typically, metal layers will find use between 1 micron and 2 nanometers.

Typical metallized films used for the applications described include but are not limited to aluminum, gold, and copper. Vacuum metallizing involves heating the coating metal to its boiling point in a vacuum chamber, then letting condensation deposit the metal on the substrate's surface. Resistance heating, electron beam, or plasma heating is used to vaporize the coating metal. Vacuum metallizing was used to deposit aluminum on the large glass mirrors of reflecting telescopes, such as with the Hale telescope.

For chemical vapor deposition (CVD), some metals (notably aluminum and copper) are seldom or never deposited by CVD. As of 2002, a commercially, cost effective, viable CVD process for copper did not exist, though copper formate, copper(hfac)$_2$, Cu(II) ethyl acetoacetate, and other precursors have been used. Copper deposition of the metal has been carried out mostly by electroplating, in order to reduce the cost. Aluminum can be deposited from tri-isobutyl aluminum (TIBAL), tri ethyl/methyl aluminum (TEA,TMA), or dimethylaluminum hydride (DMAH), but physical vapor deposition methods are usually preferred.

Metallized Mylar and/or polyester films including both the metallized opaque layer and underlying plastic resin-based film require the properties of being thin, present good thermal transfer characteristics, do not adversely affect the performance of a thermal print heads in a thermal printing unit, have the strength and integrity to act as a robust laminate in on-demand secured printing articles, can be utilized with commercial printing and processing presses and equipment, are affordable for the applications of interest, are highly obscuring and do not readily reveal printed information in a secured printed article, are visually appealing, may or may not be further printed on the exposed side with ancillary information for use, are flexible and can be readily manipulated, have good adhesion characteristics between the resin substrate and the metal layer such that the film is stable to adhesives and laminating process necessary for making functional articles.

Also of relevance to the selection of an obscuring film layer for on-demand secured printing applications is the adjustability and surface characteristic of the inner side of the layer that either possesses a visualizing dye system or interacts with the visualizing dye system. Obscuring inner surfaces find use that can (a) permanently adhere a dye composition such as an irreversible dye layer, (b) transfer a sublimation dye composition, or (c) act to facilitate contact with a dye system on the apposing substrate color generation layer for image development. Obscuring layers described herein including, but not limited to metallized films can have the pluralistic and novel characteristics of achieving multiple usages as described above.

Obscuring films used in on-demand secured printed documents can range in thickness depending on the sensitivity of a dye system or printing format utilized for a particular application or secured printed product type. By way of example, for thermal printing units that deliver moderate to low temperatures and printing energies, it is desirable to used thin highly responsive obscuring films. In other cases when printing units are utilized that operate at higher printing temperatures and energies, it is feasible to utilized thicker less responsive obscuring films.

Obscuring films can find use in the range 2 microns to 500 microns in thickness when including an obscuring component and the film resin component. Often, films will be utilized in the range between 3 microns and 250 microns. More often, films ranging between 4 microns and 100 microns. Usually films possessing adequate integrity, commercial availability, and properties for the application will range between 5 microns and 50 microns in film thickness.

Underlying film compositions can include, but are not limited to plastic resins such as Mylar based films, polyesters, extruded polyesters, BOPP, PET, polypropylene, polyethylene, nylon, thin papers, paper/plastic laminates, pure metal foils, printed papers, printed plastic films, cast films, UV cured resins, co-polymer resins, vapor deposited films that exhibit adequate physical and chemical properties, coated substrates, calendered films and papers, highly compressed films, decorated films, protective films, antistatic films, thin but flexible ceramic films.

Often it will desirable to utilized sustainable films and constructs that are considered to be sustainable, can be recycled, or can be bio-degraded. In particular, it will be important for high volume applications that film components such as aluminum or other metals, dyes utilized to increase opacity, plastics in resins, adhesives, papers to be utilized to be environmentally compatible.

Non-Obscuring Sublimation/Transfer Films

Certain applications benefit from the use of non-obscuring sublimation transfer substrates where the transfer layer contains an non-visual or non-apparent composition. By way of example, not limitation, a non-visual or non-apparent transfer sublimation layer composition can contain an invisible ink that can only be seen in the presence of a UV visualization source. The invisible ink when transferred from the upper layer interacting with the printing unit to the apposing substrate layer generates a non-visible pattern until UV light is exposed and an on-demand printed image can be revealed. Fluorescence energy excitation, fluorescence energy transfer, and fluorescence energy quenching can be employed as mechanisms for visualization.

Alternatively, the sublimation transfer process can be utilized to induce interaction between two members of a chemiluminescent chemical reaction whereby after printing the two members are able to directly chemically react giving rise to the visualization of the printed image or message. A wide range of physical, optical, electrical, electrochemical and chemical reactions can be induced using the sublimation transfer mechanisms described herein.

Transfer/Sublimation Constructs and Mediums

Thermal sublimation and transfer inks can be prepared using an organic dispersion medium combined with a visual colorant, dye or pigment composition. The sublimation/transfer ink can be directly printed on the inner unexposed surface of an opaque film. Discrete patterns, printed material, informational material graphics are conveniently transferred by pressure or a direct thermal printing unit to generate transferred visual images on the apposing side of a laminated construct.

Organic dispersion mediums can included, but are not limited to a wide range of dispersed or dissolved pigments and dyes: encapsulated dyes, FD&C food-dyes, industrial dyes, natural dyes and pigments, fluorescent dyes, leuco dyes, thermochromic dyes, stationary dyes, metallic dyes, glitters, glow in the dark pigments, carbon black inks, photochromic dyes, hysteresis dyes, invisible dyes, re-writeable thermal printing dyes, organic dyes and pigments can be formulated into an emulsion transfer system.

Carnauba, paraffin, polyethylene waxes, sharp melting point waxes, surfactant emulsifications, hydrocarbon emulsifications, transfer waxes, transfer melting point mediums can be emulsified or utilized as transfer vehicles. Colorized crayon waxes and maker waxes may be employed as dye transfer mediums.

Carnauba wax can produce a glossy finish and as such is used in automobile waxes, shoe polishes, food products such as candy corn, instrument polishes, and floor and furniture polishes, especially when mixed with beeswax. It is used as a coating on dental floss. Use for paper coatings is the most common application in the United States. It is the main ingredient in surfboard wax, combined with coconut oil.

Carnauba wax contains mainly esters of fatty acids (80-85%), fatty alcohols (10-16%), acids (3-6%) and hydrocarbons (1-3%). Specific for carnauba wax is the content of esterified fatty diols (about 20%), hydroxylated fatty acids (about 6%) and cinnamic acid (about 10%). Cinnamic acid, an antioxidant, may be hydroxylated or methoxylated.

Carnauba wax has a sufficiently high melting transition that it will remain stable during processing, shipping, storage, latency in an operating thermal printer, approach and proximity to thermal print heads. Carnauba and other wax/paraffin formulations that have melting transitions in the 140° F. to 220° F. range are particularly useful for on-demand secured printing applications. More often, formulations in the 160° F. to 210° F. will be utilized. Most often formulations in the 160° F. to 200° F. range will find use.

Carnauba wax and related blend can serve as primary transfer/sublimation mediums for various dye systems disclosed herein for on-demand secured printing applications. Commercially available emulsions and suspensions enable the rapid and simple formulation of wide range of ink formulations that that have been successfully utilize for the purposes described herein.

Particular wax blends and emulsifications both natural and synthetic can be selected for particular applications and product formats. Commercial vendors and suppliers include, but are not limited to: GE Chaplin, Inc., Parchem, Inc., Penta Manufacturing Company, Kromachem LTD., Michelman, Inc., Advanced Polymer, Inc., and Chemcor Company.

Waxes, paraffin, mixed hydrocarbons, long chain esters and alcohols, carnauba, sharp melting point organic compositions, and other related compositions can be used as transfer/sublimation ink formulations in emulsified forms from 1% solids to paste forms of over 80%. Usually solids concentrations will find use between 10% and 70%. More usually concentrations will range between 20% and 60%. Most often solids concentrations will range between 30% and 50% solids. The solids concentrations will depend on the particular application of interest.

The sublimation-dye transfer process is enabled by rapidly and readily changing the phase state of the melting transition carrier medium from a film solid to a transferable liquid state that releases from the obscuring layer and transfers to the apposing accepting substrate. The liquid phase contacts, permeates, and attaches irreversibly to the accepting substrate to generate an image of interest in a secured on-demand printed document.

The transfer-sublimation medium in combination with dye additives should collectively transfer efficiently and fully for optimal imaging. Dye concentrations for particular applications should provide sufficiently rich and colorful printing and be able to support barcode readable formats. Likewise, the concentration of an active dye component should not be so high that it interferes with the transfer process.

Typically active dye components can range form 1% dye to paste forms of over 80%. Usually dye concentrations will find use between 2% and 50%. More usually concentrations will range between 5% and 40%. Most often dyes concentrations will range between 10% and 30%. The dye concentrations will depend on the particular application of interest.

Because of its hypoallergenic and emollient properties as well as its shine, carnauba wax appears as an ingredient in many cosmetics formulas where it is used to thicken lipstick, eyeliner, mascara, eye shadow, foundation, deodorant, various skin care preparations, and sun care preparations.

Natural co-developer-solvents for descending color development can be used from 99.9% total composition weigh to 1%. More usually, co-developer/solvents are used from between 99% to 1% by weight. Typically they are used between 95% and 5%. Most often, they will find use from between 90% and 20% by weight total composition.

Natural co-developer-solvents provide for low to high temperature range reversible descending temperature color change compositions. By way of example, but not limitation, co-developer-solvents can be formulated using analog compositions of carnauba wax. Longer chain alcohol and or ester compounds can be separated or added during the processing and purification phase of preparing carnauba wax.

Carnauba wax and other related natural formulations can be used to produce reversible color change compositions from below 0° C. to above 150° C. Commonly commercially available leuco dye compositions are typically limited to 70° C. and primarily include synthetic melting point compositions and developers.

Natural mediums for thermal sublimation transfer on-demand secured printing articles can be prepared using micro-emulsions of carnauba wax. Carnauba wax mediums can be prepared in a concentrated form for single coat applications used for printing or in lower concentration solid forms for multi-coat printing applications. By way of example, Michelman carnauba dispersion can be obtained from Michelman Corp. ML156, a low solids formulation (25%) can be used for multi-coat applications (2-4 coats) to ensure adequate transfer thicknesses. ML156 can be concentrated to 50% volume by continuous stirring and forced air flow. Concentrated natural sublimation/transfer mediums can be prepared at 50% by volume solids. Concentrated ML156 formulations can be used for single-coat applications. Likewise, pre-concentrated formulations can be prepared with 35% solids using ML156HS and ML160HS at 50% solids.

Sublimation transfer ink formulations can be made by homogenizing an optical agent listed above from between 5% and 25% by weight in an aqueous micro-emulsion such as ML156, ML156 concentrated by 50%, ML156HS, or ML160HS. Mixtures can be made uniform using aggressive agitation for 30 minutes at room temperature. Surfactants can be added up to 1% in the event that certain optical agents were difficult to directly disperse in the micro-emulsion. Homogeneously mixed inks are generally ready for use after adequate dispersion or can be stored under ambient conditions as required.

Transfer/Sublimation Dyes and Pigments

Aqueous sublimation/transfer dispersions are practical to use directly with various optical agents including, but not limited to: powdered dyes, liquid concentrated dyes, pigmented dyes, thermochromic reversible pigmented dyes thermochromic irreversible dyes, hysteresis thermochromic dyes, invisible security dyes, various colored food FD&C dyes, fluorescent dyes, carbon based dyes, glow-in-the-dark compounds, polydiacetylenic dyes, diacetylenic monomeric compounds, IR sensitive dyes, photochromic dyes, metal flake, glitter, optical pigments, color developers, and color formers.

Transfer mediums can be utilized as carriers of dyes, pigments, thermochromic dyes, metallic particles, fluorescent dyes, mixed dye systems, FDA approved dyes and FD&C, natural dyes, organic and inorganic dyes, dyes illuminated and apparent only under black light or UV light, infrared dyes, refractive index sensitive dyes, magnetic compounds, paramagnetic compounds, conducting polymers, conducting nano-particles, silver conducting particles, and semi-conducting materials.

| FD&C # | Hue | Name | Common Uses |
|---|---|---|---|
| Blue #1 | Bright Blue | Brilliant Blue | Beverages, powders, jellies, confections, condiments, icings, syrups, extracts |
| Blue #2 | Royal Blue | Indigotine | Baked goods, cereals, snack foods, ice cream, confections, cherries |
| Green #3 | Sea Green | Fast Green | Beverages, puddings, ice cream, sherbet, cherries, baked goods, dairy products |
| Red #3 | Cherry-Red | Erythrosine | Canned Cherries, confections, baked goods, dairy products, snack foods |
| Red #40 | Orange-Red | Allura Red | Gelatins, puddings, dairy products, confections, beverages, condiments |
| Yellow #5 | Lemon Yellow | Tatrazine | Custards, beverages, ice cream, confections, preserves, cereals |
| Yellow #6 | Orange | Sunset Yellow | Cereals, baked goods, snack foods, ice cream, beverages, confections |

Polymeric Thermochromic Ink Compositions

Polymeric inks can be tuned to be used with thicker or thinner opaque obscuring films for printing on the underlying substrate and on the back side of the obscuring film layer. A triggering transition temperature can be formulated from room temperature to over 300° F. Most often, tunable polymeric inks will be formulated to be at a convenient transition temperature to enable the construct of interest and to select a thermal printer of interest.

Compatible systems for generating color development reversibly, irreversibly, from colorless to a colored state based on ascending temperature, from a colored state to a colorless state based on descending temperature, solvation, hydration, or other chemical and physical stimuli to a colored state to a colorless state during the stimuli. Color transitions can be with and without color change hysteresis, including abrupt or broad transition color change options, utilize micro-encapsulation processes or un-encapsulated processes, and can find use in a wide range of applications. Natural product food-grade color developers are available for both ascending and descending color change compositions. Combinatorial chemistries, including leuco dye color formers and polydiacetylenic-based compounds, can serve as developers and possess their own intrinsic color change properties, which can be utilized in conjunction with certain embodiments of the invention and are described further herein.

Polymeric ink formulations can be pre-polymerized and set at a given temperature setting for a pre-formulated ink or can be produced in a monomeric form and polymerized in-line and prior to assembly of an on-demand secured printed document. In either case, the temperature setting and approach for formulation and polymerization provide for flexibility of adapting the temperature setting and dynamic or static sensitivity for a range of product applications of interest.

Pre-polymerized ink formulations can conveniently prepared in aqueous ink vehicles. Aqueous ink formulations have the benefit of avoiding undesirable volatile solvents that most result in environmental concerns upon evaporation. Pre-polymerized aqueous ink are prepared by emulsifying monomeric diacetylenic compositions either in the crystalline state to a micro-particulate state or by forming an oil phase above the melting transition of the monomer and aggressively mixing the composition to a stable micro-emulsion form.

Aqueous vehicles can be selected for particular applications depending on their utility and compatibility with particular diacetylenic monomeric compounds. Upon adequate emulsification and particle sizing, the diacetylenic composition can be polymerized by using 254 nanometer ultraviolet light from a colorless to an enriched blue coloration typical and indicative of the polydiacetylene polymerization reaction. Alternatively, polymerization can be accomplished by using a gamma irradiation source of other compatible high-energy source such as cobalt 60.

Formulated polymeric inks can be used directly with commercial printing process, but importantly will need to be adjusted in viscosity, surface tension, surfactant loading, temperature setting, particle sizing, and ancillary component content depending on the application of interest. Similarly, stabilizing agents, preservatives, and anti-oxidants can be employed for improved shelf-life and stability.

Monomeric components can generally be added at between 0.1% and up to 50% by weight. Usually, monomeric components will be added between 1% and 30% by weight to the final ink composition. More often, they will be added between 5% and 20% by weight. The exact concentration and monomeric composition depends on such factors as the desired loading, coloration intensity required, anilox roller loading, and printing method.

Solvent base diacetylenic inks find use where it is practical to formulate a solvent based ink with dissolved diacetylenic monomers. Solvent provide for maintaining monomers in the dissolved state. When solvent based monomeric diacetylenic inks are printed and dried, the drying process facilitates the rapid and homogenous crystallization of the diacetylenic monomer. Once the monomeric solvent base ink has been printed and dried, the ink can be polymerized from a colorless state to a color blue state typical and illustrative of the formation of the polydiacetylenic polymer back bone.

The degree of polymerization can be utilize to adjust the temperature transition of the polymer color change thereby providing a convenient method to tune the ink temperature setting depending on the application of interest. By way of example, selected long chain diacetylenic compounds can be tuned in temperature form 120° F. to 200° F. depending on the level of polymerization. Uses and application diacetylenic and polydiactylenic compounds are well described elsewhere (Ribi U.S. Pat. Nos. 5,918,981 and 5,685,641).

Compatible Pigmented Irreversible Thermochromic Ink Compositions

Pigmented polymeric inks can be use with slightly thicker opaque obscuring films for printing on the back side of the obscuring film or with thin obscuring films for printing on the underlying substrate. Commercially available irreversible pigmented thermochromic inks can be utilized in on-demand secured printed documents provided that the temperature transition, dynamic sensitivity and static sensitivities are suitable for the particular application of interest. Irreversible thermochromic inks can be sourced form commercial sources (e.g. Segan Industries, Inc. or Nucoat, Inc.) or prepared accordingly (Ribi, WO2008079357 A2) as well as other commercial sources.

Tunable compositions can be micro-encapsulated or non-micro-encapsulated depending on the application of interest. Encapsulate species provide the inherent robustness for many matrices or mediums such as plastics, certain paints, or robust coatings. Un-micro-encapsulated species provide a lower cost means to utilize said compositions where the compositions can be administered to a product application in fewer lest costly steps. Various permutations of encapsulated on un-encapsulated tunable color generation compositions can be utilized. By way of example, but not limitation, developers and color formers can both be un-encapsulated. Alternatively, the developer can be encapsulated where as the color former may be un-encapsulated. In another example, the developer may be un-encapsulated whereas the color former may be encapsulated. In addition, varying degrees of encapsulation may be utilized by one component or another.

Typically, irreversible pigmented thermochromic inks exhibit temperature thresholds in the range between 40° C. and 120° C. Usually, transition temperatures will find use between 50° C. and 110° C. with temperature transition will range between 60° C. and 100° C. most favored.

Irreversible pigmented inks can be formulated to adhere to and printed on the inner side of the opaque film layer or on the surface of the apposing substrate layer of the construct. Alternatively, the ink can be used as a sublimation transfer composition whereby it will simultaneously change color and transfer form the underlying side of the opaque layer to the apposing substrate layer through the sublimation transfer process and simultaneously change color due to thermal heating. Importantly, pigmented adjustable irreversible color change inks provide a flexibility for use in various construct configurations and uses with different thickness of opaque obscuring layers.

Compatible Reversible Thermochromic Leuco Dye Compounds

Thermochromic dyes and colorants can be added to the composition formulation to serve as an indicating means to show that a particular composition has been temperature activated for optimal use. Temperature ranges for thermochromic transitions can be below freezing to above boiling depending on the intended use of the thermochromic composition application. Thermochromic dyes can find use in a variety of compositions and applications and formats. Thermochromic dyes can include but are not limited to compounds including: bis(2-amino-4-oxo-6-methylpyrimidinium)-tetrachlorocuprate(II); bis(2-amino-4-chloro-6-methylpyrimidinium) hexachlorod-icuprate(II); cobalt chloride; 3,5-dinitro salicylic acid; leuco dyes; spiropyrenes, bis(2-amino-4-oxo-6-methylpyrimidinium)tetrachlorocuprate(II) and bis(2-amino-4-chloro-6-methylpyrimidinium) hexachlorodicuprate(II), benzo- and naphthopyrans (Chromenes), poly(xylylviologen dibromide, di-beta-naphthospiropyran, Ferrocene-modified bis(spiropyridopyran), isomers of 1-isopropylidene-2-[1-(2-methyl-5-phenyl-3-thienyl)ethylidene]-succinic anhydride and the Photoproduct 7,7adihydro-4,7,7,7a-tetramethyl-2-phenylbenzo[b] thiophene-5,6-dicarboxylic anhydride, micro-encapsulated dyes, precise melting point compositions, infra-red dyes, spirobenzopyrans, spironnapthooxazines, spirothopyran and related compounds, leuco quinone dyes, natural leuco quinone, traditional leuco quinone, synthetic quinones, thiazine leuco dyes, acylated leuco thiazine dyes, nonacylated leuco thiazine dyes, oxazine leuco dyes, acylated oxazine dyes, nonacylated oxazine leuco dyes, catalytic dyes, combinations with dye developers, arylmethane phthalides, diarylmethane phthalides, monoarylmethane phthalides, monoheterocyclic substituted phthalides, 3-heterocyclic substituted phthalides, diarylmethylazaphthalides, bisheterocyclic substituted phthalides, 3,3-bisheterocyclic substituted phthalides, 3-heterocyclic substituted azaphthalides, 3,3-bisheterocyclic substituted azaphthalides, alkenyl substituted phthalides, 3-ethylenyl phthalides, 3,3-bisethylenyl phthalides, 3-butadienyl phthalides, bridged phthalides, spirofluorene phthalides, spirobensanthracene phthalides, bisphthalides, di and triarylmethanes, diphenylmethanes, carbinol bases, pressure sensitive recrcording chemistries, photosensitive recording chemistries, fluoran compounds, reaction of keto acids and phenols, reactions of keto acids with 4-alkoxydiphenylamines, reactions of keto acids with 3-alkoxdiphenylamines, reactions of 2'-aminofluorans with aralkyl halides, reaction of 3'-chlorofluorans with amines, thermally sensitive recording mediums, tetrazolium salts, tetrazolium salts from formazans, and tetrazolium salts from tetazoles.

Other thermochromic dyes of interest include leucodyes including color to colorless and color to color formulations, vinylphenylmethane-leucocyanides and derivatives, fluoran dyes and derivatives, thermochromic pigments, micro and nano-pigments, molybdenum compounds, doped or undoped vanadium dioxide, indolinospirochromenes, melting waxes, encapsulated dyes, liquid crystalline materials, cholesteric liquid crystalline materials, spiropyrans, polybithiophenes, bipyridine materials, microencapsulated, mercury chloride dyes, tin complexes, combination thermochromic/photochromic materials, heat formable materials which change structure based on temperature, natural thermochromic materials such as pigments in beans, various thermochromic inks sold by Securink Corp. (Springfield, Va.), Matusui Corp., Liquid Crystal Research Crop., or any acceptable thermochromic materials with the capacity to report a temperature change or can be photo-stimulated. The chromic change agent selected generally depends on a number of factors including cost, material loading, color change desired, levels or color hue change, reversibility or irreversibility, and stability.

Alternative thermochromic materials can be utilized including, but not limited to: light-induced metastable state in a thermochromic copper (II) complexChem. Commun., 2002, (15), 1578-1579 under goes a color change from red to purple for a thermochromic complex, [Cu(dieten)2](BF4)2 (dieten=N,N-diethylethylenediamine); encapsulated pigmented materials from Omega Engineering Inc.; bis(2-amino-4-oxo-6-methyl-pyrimidinium)-tetrachlorocuprate (II); bis(2-amino-4-chloro-6-methylpyrimidinium) hexachlorod-icuprate(II); cobalt chloride; 3,5-dinitro salicylic acid; leuco dyes; spiropyrenes, bis(2-amino-4-oxo-6-methylpyrimidinium)-tetrachlorocuprate(II); bis(2-amino-4-chloro-6-methylpyrimidinium)hexachlorod-icuprate(II); cobalt chloride; 3,5-dinitro salicylic acid; leuco dyes; spiropyrenes, bis(2-amino-4-oxo-6-methylpyrimidinium)tetrachlorocuprate(II) and bis(2-amino-4-chloro-6-methylpyrimidinium)hexachlorodicuprate(II), benzo- and naphthopyrans (Chromenes), poly(xylylviologen dibromide, di-beta-naphthospiropyran, Ferrocene-modified bis(spiropyridopyran), isomers of 1-isopropylidene-2-[1-(2-methyl-5-phenyl-3-thienyl)ethylidene]-succinic anhydride and the Photoproduct 7,7adihydro-4,7,7,7a-tetramethyl-2-phenyl-benzo[b]thiophene-5,6-dicarboxylic anhydride. Encapsulated leuco dyes are of interest since they can be easily processed in a variety of formats into a plastic or putty matrix. Liquid crystal materials can be conveniently applied as paints or inks to surfaces of color/shape/memory composites.

Thermochromic color to colorless options can include by way of example, but not by limitation: yellow to colorless, orange to color less, red to colorless, pink to colorless, magenta to colorless, purple to colorless, blue to colorless, turquoise to colorless, green to colorless, brown to colorless, black to colorless. Color to color options include but are not limited to: orange to yellow, orange to pink, orange to very light green, orange to peach; red to yellow, red to orange, red to pink, red to light green, red to peach; magenta to yellow, magenta to orange, magenta to pink, magenta to light green, magenta to light blue; purple to red, purple to pink, purple to blue; blue to pink; blue to light green, dark blue to light yellow, dark blue to light green, dark blue to light blue; turquoise to light green, turquoise to light blue, turquoise to light yellow, turquoise to light peach, turquoise to light pink; green to yellow, dark green to orange, dark green to light green, dark green to light pink; and brown and black to a variety of assorted colors. Colors can be deeply enriched using fluorescent and glow-in-the-dark or photo-luminescent pigments as well as related color additives.

Reversible and irreversible versions of the color change agent can be employed depending on the desired embodiment of interest. Reversible agents can be employed where it is desirable to have a multi-use effect or reuse the color change effect. For example, products with continued and repeated use value will find utility of a reversible color change component comprising the final embodiment. In this case it would be desirable to utilize a reversible thermochromic or luminescent material which can be repeated during usage. In another example, it may be desirable to record a single color change permanently. In this case, it would be desirable to utilize a thermochromically irreversible material which changes from one color to another giving rise to a permanent change and indicating that the composition should be discarded after use.

Direct Thermal Printed Papers, Films, and Substrates

Static sensitivity should be considered when selecting a direct thermal substrate for on-demand secured printing. Static sensitivity indicates the temperature at which a thermal paper will begin imaging. Thermal papers with low static sensitivity only begin imaging at high temperatures; thermal papers with higher static sensitivity begin imaging much earlier (between 70 and 75° C.).

Static sensitivity can be important if the thermal paper is to be used in high-temperature environments. Thus, thermal papers with low static sensitivity are used for parking tickets, or for in-vehicle applications, since temperatures under the windscreen of a vehicle can exceed 80° C. on a hot summer day. The printout must remain legible even under such conditions.

Dynamic sensitivity of thermal papers indicates how fast a thermal paper can be printed. This is especially relevant in the selection of the right thermal paper for a particular thermal printer, since the higher the dynamic sensitivity of the paper, the faster the printer can operate without any settings having to be changed. In mobile printers that typically operate at slower speeds than desk top printers, dynamic sensitivity is often less important than static sensitivity.

The sensitivity of a thermal paper refers to the degree to which it reacts to heat (energy). A high sensitivity product will generally create a better image than a low sensitivity product when given less heat or energy. Images that need to be rich and dark generally require a high sensitivity thermal paper.

Paper sensitivity can be measured on a dynamic sensitivity curve, which is an X-Y graph that measure energy in mill joules vs. density. A fully developed thermal image will typically be 1.2 density reading or greater. The dynamic sensitivity curve shows how fast a thermal paper will image or print. This can be especially important when selecting the thermal printer, since the higher the dynamic sensitivity of the paper, the faster the printer is able to operate. Dynamic sensitivity curves are available for a complete range of thermal papers.

High sensitivity applications can include barcodes, thermal ticket ATM receipts, parking tickets and high speed thermal printers. Alternatively, images that do not need to be as crisp can be created on low sensitivity products.

Low sensitivity applications include standard point of sale receipts, supermarket weigh scale labels, and distribution and logistics labels. Static Sensitivity curves can be important when considering using thermal paper in adverse environmental conditions like high temperature and UV exposure. Lower static sensitive thermal paper is generally used to ensure that the media will not image due to heat from the sun or any other external source. There are top coated sheets available that can help in extreme instances where a need exist to balance generating a good thermal image with not getting any unwanted background development. In general, paper sensitivity is a balance of the paper, printer and environment in which they are being used. 80-90% of the applications use a standard grade thermal paper and function well. There are also many thermal printers used in harsh environmental conditions that function very well using special coated thermal products that fit the application.

On-demand secured printed materials can be utilized in full range of applications by utilizing enabling features of thin opaque obscuring films in combination with commercially available direct thermal papers and films. Simple functional products can be prepared by laying the obscuring film directly over the direct thermal layer. Air gaps between the two layers provide for simple de-lamination and exposure of securely printed information.

Direct thermal printed papers including, but not limited to commercially available papers from major suppliers and manufactures. Direct thermal papers and films most readily adjusted will be those with thermal compositions and coating amenable to localized changes that can be introduced by introduction and interaction of the adhesive overlay. The intended up-shift or downshift in thermal characteristics of the direct thermal transfer substrate will depend on the intended application of interest, the degree of temperature change intended and the time intended for introducing and optical change in the substrate.

Similarly, a commercially available direct thermal coated substrate can be converted into a time only indicating substrate depending upon the thermal coating composition and provided protective coating. By adjusting the aggressive nature of the adhesive overlay, the solvent content, the acid/basic nature of the adhesive employed and any intended augmenting agents comprising the adhesive composition, application of the adhesive laminate can be utilized for conversion of the substrate to shorter or longer duration time indicators.

Less thermally active or sensitive thermal commercially papers and films can find use as acceptably active color generating substrates by using sensitizing coatings coated on top of or transferred to the top of the direct thermal substrate. Marginally active direct thermal printing substrates can be increased in sensitivity by applying a sensitizing layer to either the surface of the direct thermal printing substrate or through a thermal transfer ink that carries and delivers a sensitizing agent to the surface of the direct thermal transfer layer during the process of secured on-demand printing.

Likewise, acceptably active direct thermal substrate and thicker less thermally responsive obscuring layers or films can find use particularly if a sensitizing agent is utilized in conjunction with a combined less active direct thermal substrate/obscuring layer. In either case, sensitizing agents can be utilized that improve the sensitivity of commercially available materials thereby increasing the range of available obscuring/opaque layers, direct thermal substrates, and thermally active ink compositions.

Example of direct thermal recording substrates available and useful from Appleton Papers Inc. include:

| Part Number | Description |
|---|---|
| 3802-0221 | RESISTE 600-4.4 8⅞ 5M |
| 2137-0036 | RESISTE 200-3.1 61 9M |
| 4723-0086 | RESISTE 500-3.4 9½ 1M |
| 4723-0044 | RESISTE 500-3.4 9¼ 9M |
| 3802-0227 | RESISTE 600-4.4 7 6M |
| 3802-0080 | RESISTE 600-4.4 40½ 4.5M |
| 4723-0051 | RESISTE 500-3.4 13 5/16 6M |
| 3802-0182 | RESISTE 600-4.4 13 13/32 9M |
| 4211-0016 | RESISTE 800-7.2/T954 17 6.5M |
| 4723-0092 | RESISTE 500-3.4 8¾ 9M |
| 3802-0224 | RESISTE 600-4.4 13 19/32 4.85M |
| 2137-0018 | RESISTE 200-3.1 27 9M |
| 3802-0043 | RESISTE 600-4.4 13⅜ 6M |
| 3802-0254 | RESISTE 600-4.4 19⅞ 7M |
| 3802-0195 | RESISTE 600-4.4 19½ 9M |
| 3802-0007 | RESISTE 600-4.4 13½ 9M |
| 3802-0247 | RESISTE 600-4.4 10¾ 7.778M |
| 3802-0167 | RESISTE 600-4.4 16½ 1M |
| 2137-0026 | RESISTE 200-3.1 10 .5M |
| 3802-0256 | RESISTE 600-4.4 16 15/16 9M |
| 4723-0058 | RESISTE 500-3.4 9½ 6M |
| 3802-0145 | RESISTE 600-4.4 26⅞ 6M |
| 4723-0042 | RESISTE 500-3.4 16½ 9M |
| 4723-0002 | RESISTE 500-3.4 24½ 6M |
| 3802-0142 | RESISTE 600-4.4 5 3M |
| 3802-0151 | RESISTE 600-4.4 13½ 6M |
| 3802-0138 | RESISTE 600-4.4 5 4.5M |
| 3802-0000 | RESISTE 600-4.4 |
| 3802-0130 | RESISTE 600-4.4 4¾ 4.5 |
| 3802-0065 | RESISTE 600-4.4 12¼ 6M |
| 2137-0022 | RESISTE 200-3.1 50 6.667M |
| 4723-0087 | RESISTE 500-3.4 39¼ 9M |
| 4723-0003 | RESISTE 500-3.4 48½ 6M |
| 3802-0106 | RESISTE 600-4.4 13 1M |
| 4211-0024 | RESISTE 800-7.2/T954 13 1M |
| 2137-0028 | RESISTE 200-3.1 53¼ 9M |
| 4211-RL | RESISTE 800-7.2/T954 |
| 3802-0116 | RESISTE 600-4.4 15 4.5M |
| 3802-0238 | RESISTE 600-4.4 5 13/16 6M |

-continued

| Part Number | Description |
|---|---|
| 3802-0250 | RESISTE 600-4.4 16¾ 5.2M |
| 7041-SH | 62 C1S PEARLESCENT LABEL |
| 3609-SH | C1S CREAM LABEL |
| 3659-0087 | T1062A OPTIMA LABEL 40" 9M |
| 3796-RL | C1S PK FLUOR LABEL |
| 4946-RL | BASE-COATED LABEL STOCK - 13CM |
| 7377-0000 | BLADE COAT THERMAL LABEL |
| 0000-3909 | C1S #270 CRM LABEL 25 × 38 |
| 3659-0033 | T1062A OPTIMA LABEL 30¾" 6M |
| 3659-0065 | T1062A OPTIMA LABEL 40" 6M |
| 4946-0001 | BASE-COATED LABEL STOCK - 13CM |
| 3659-0063 | T1062A OPTIMA LABEL 8½" 6M |
| 3608-0009 | C1S CAN LABEL 38 × 50 |
| 3659-0101 | T1062A OPTIMA LABEL 60¾" 9M |
| 3659-0015 | T1062A OPTIMA LABEL 53" 4.5M |
| 5194-0001 | BARRIER LABEL 62#FDA 20.5 × 23.5 |
| 7041-0000 | 62 C1S PEARLESCENT LABEL |
| 3608-0000 | C1S CAN LABEL |
| 7377-RL | BLADE COAT THERMAL LABEL |
| 3608-RL | C1S CAN LABEL |
| 3659-0128 | T1062A OPTIMA LABEL 60¾ 12M |
| 3659-0169 | T1062A OPTIMA LABEL 52" 12M |
| 3659-0155 | T1062A OPTIMA LABEL 24" 3M |
| 3610-RL | C1S IVORY LABEL |
| 3659-0119 | T1062A OPTIMA LABEL 13" 9M |
| 3823-RL | SC SP TAN LABEL |
| 3608-0010 | C1S CAN LABEL 25 × 38 |
| 3659-0165 | T1062A OPTIMA LABEL 61" 9M |
| 3796-SH | C1S PK FLUOR LABEL |
| 3796-0000 | C1S PK FLUOR LABEL |
| 0000-1227 | 150 AP LABEL PLT 61" 9.666M. |
| 4946-0000 | BASE-COATED LABEL STOCK - 13CM |
| 3801-SH | C1S SP BUF LABEL |
| 3659-0034 | T1062A OPTIMA LABEL 38⅝" 9M |
| 7041-RL | 62 C1S PEARLESCENT LABEL |
| 0000-2711 | C1S 259 GLD AP LABEL 26 × 20 |
| 3801-RL | C1S SP BUF LABEL |
| 5021-0001 | GENDATA LABEL-2.1 53 3M |
| 3609-RL | C1 SCREAM LABEL |
| 3659-0105 | T1062A OPTIMA LABEL 26½" 6M |
| 3659-0085 | T1062A OPTIMA LABEL 61¼" 9M |

Examples of direct thermal substrates (paper and film) from Kanzaki Specialty Papers:

| Point of Sale Colormax ™ | | | | |
|---|---|---|---|---|
| P-320BB | 2.27 | 2-Color Printer | High | 10 |
| (Blue/Black) | | Required | Low | 5 |
| P-320GB | 2.27 | 2-Color Printer | High | 10 |
| (Green/Black) | | Required | Low | 5 |
| P-320RB | 2.27 | 2-Color Printer | High | 10 |
| (Red/Black) | | Required | Low | 5 |

| Product | Caliper (mils) | Sensitivity | Environmental Resistance | Achievability Years |
|---|---|---|---|---|
| Paper Thermal Imaging Products | | | | |
| LOTTO-482 | 3.16 | Standard | Ultra High | 20 |
| LOTTO-462 | 3.14 | Standard | Ultra High | 20 |
| LOTTO-850 | 3.14 | Standard | High | 20 |
| TO-381N | 4.40 | Ultra High | Ultra High | 20 |
| TO-381NB | 4.40 | Ultra High | Ultra High | 20 |
| TOTE-200 | 3.85 | Standard | Medium | 7 |
| Synthetic Thermal Imaging Products | | | | |
| S-250 | 3.19 | High | Low | 10 |
| KPT-3270 | 3.00 | Standard | High | 20 |
| KPT-3370 | 3.08 | High | High | 20 |
| KPT-3380 | 3.50 | High | High | 20 |
| KPT-33100 | 4.20 | High | High | 20 |
| KPT-13150 | 5.90 | High | High | 20 |

-continued

| | | | | |
|---|---|---|---|---|
| KPT-3470 | 3.00 | Ultra High | High | 20 |
| KPT-3480 | 3.40 | Ultra High | High | 20 |
| KPL-2370 | 3.10 | High | Medium | 10 |
| KPL-5270 | 3.30 | High | Medium | 10 |
| KTT-333 | 3.40 | N/A | N/A | N/A |
| Thermal Tag | | | | |
| KT-200 | 7.3 | Medium | High | 10 |
| KT-300 | 7.3 | Ultra High | High | 10 |
| KTB-442 | 7.0 | High | High | 10 |
| MAG-390 | 7.2 | High | High | 10 |
| ST-5 | 5.3 | High | High | 10 |
| ST-7 | 7.1 | High | High | 10 |
| KTB-399 | 10.8 | Ultra High | High | 10 |
| KT-10 | 9.5 | Ultra High | High | 10 |
| Synthetic Thermal Tag Polycash ® | | | | |
| Polycash 7/3380 | 7.5 | High | High | 10 |
| Polycash 10/3380 | 10.0 | High | High | 10 |
| Polycash 11/3470 | 11.5 | Ultra High | High | 10 |
| Polycash 10/3380TRES | 10.8 | High | High | 10 |
| Polycash 32180TR | 7.4 | Standard | High | 10 |
| Polycash 33180TR | 7.4 | High | High | 10 |
| Polycash 33250TR | 10.3 | High | High | 10 |
| Polycash 62100XTR | 4.2 | Standard | High | 10 |
| Polycash 63100XTR | 6.2 | High | High | 10 |
| Polycash 62150XTR | 4.2 | Standard | High | 10 |
| Polycash 63150XTR | 6.2 | High | High | 10 |
| Point of Sale (POS) | | | | |
| P-300 | 2.20 | Standard | Low | 5 |
| P-310 | 2.20 | Standard | Low | 5 |
| P-350 | 2.4 | High | Medium | 10 |
| P-350-2.0 | 1.9 | High | Medium | 7 |
| P-354 | 3.26 | High | Medium | 7 |
| P-530 | 2.32 | High | Medium | 7 |
| P-534 | 3.26 | High | Medium | 7 |
| KIP-380 | 3.22 | Standard | High | 10 |

Other reversible and irreversible paper or synthetic (e.g., polypropylene or polyethylene terephthalate, PET) direct thermal stocks are available from Ricoh Electronics, Inc. of Santa Ana Calif. or Lawrenceville Ga. For example, Ricoh features both physically and chemically rewritable films with specific temperature ranges for recording and erasing images.

Thermally Reactive Mediums, Layers and Substrates

By systematic and careful selection of the obscuring film characteristics and ease of thermal transmission through the film and adjusting the corresponding sensitivity of the thermally responsive imaging composition or substrate, imaging can be accomplished on either the obscuring layer directly or completely through the obscuring layer and transmitted to the apposing substrate whereby the substrate can hold and possess the secured on-demand printed information. Herein, we describe the enabling use of high heat transmission obscuring layers the effectively permit heat transmission and image development through the obscuring layer, through a contact air gap and imprinting high resolution information completely through to an apposing imaging medium in the construct.

Sensitizing Agents

Thermal induction inks can be sensitized or further augmented to reduce their temperature triggering threshold by use of additives that augment or lower the temperature transition of the thermochromic element and or matrix components responsible for dictating the temperature transition. Typical low or non-volatile additives can be used. By way of example, but not limitation, glycerol, mineral oils, various petroleum based oils, waxes, vegetable oils, saturated and unsaturated oils, melting transition mediums, critical melt point mediums, low temperature melting transition developers, organic and inorganic additives, polymeric additives, resin additives, diluents, inorganic oils, and additional color developers, can be used in combination with a thermochromic or color change medium.

Sensitizing agents find use at additive concentrations ranging from 0.01% to over 50%. More specifically, they will be used in concentrations between 0.05% and 25%. Even more specifically, sensitizing agents will find use between 0.1% and 20%. Typically and most often, they will be used between 1% and 10% of the final thermal ink induction formulation.

On-Demand Secured Printing Assembly and Constructs

Metallized polyester films (48 gage from Printpack Corp., 48 gage from CPFilms Crop., or 25 gage from Fasson North America) can be printed on commercial flexographic or related printing presses using anilox rollers to print on the obscuring film. Uniform print coating coloration can be readily visualized due to the reflective shine on the aluminum substrate. Likewise, the aluminum surface provides low adherent, semi-adherent of high adherence depending on the surface treatment properties selected and utilized for the metallized surface. Post flood coating or selectively patterning an ink of interests described above, the metallized layer can be slit to size and laminated to a thin white semi-gloss paper stock such that the ink faces inward to overlay an apposing acceptance substrate (e.g. an acceptable paper for completion of the construct). Lamination can be achieved along the edges of the construct such that the main body center of the construct is layered with a minor air gap but not directly adhered. Dual stick adhesive strips can be applied as on lamination approach in-line during production only along the edges of the upper obscuring film layer and tacking to the lower acceptance substrate. Adhesives coverings or full adherent substrates are not deemed necessary for the purposes of this invention.

On-demand secured printing pull tab tickets can be die cut to any of a number of configurations. Typically, pull tab slot tickets will range between to 2.5 inches in width and between 2.5 and 6 inches in length. The exact length of the articles depends on the ticket application of interest. Regions of release and location to "pull and delaminate" the ticket post printing can be accomplished using perforated dies in line on the printing press. Between ticket perforations can be accomplished in-line for the purpose of separating each ticket from the printer and for use post printing. Periodic registration marks can be printed on the outer surface of the paper layer along with standard and/or customized graphics. The registration marks are to be standardized for compatibility with the thermal printer model of interest.

On-demand secured printed information can be printed on assembled pull tab tickets using commercially available thermal printing units and software command language controlling the printer. By way of example, direct thermal printers from CyberTech Gaming Systems, Inc, Zebra Technologies, Inc., Seiko Corp., Brother USA, Dymo Company and a range of other direct and indirect thermal printers can be utilized. In addition, on-demand information can be printed on tickets or other similar constructs using direct thermal printers from FutureLogic, Inc. of Glendale, Calif., including Gen I, Gen II, and Gen II printers, as well as thermal printers from TransAct Technologies Inc. of Hamden, Conn. and Nanoptix Inc. of Dieppe, New-Brunswick, Canada. The printers can receive perforated fan-folded or roll-supplied stocks and can incorporate a fragile perforation or a cutting device for dispensing the tickets or other constructs.

Ticket examples can be printed such that the obscuring film (metallized or the like) side of the ticket comes in direct contact with the thermal print head unit during printing. The substrate side enters the printer face up with registration marks and customized graphics visually face up. Printed tickets can be successfully printed with commercial printing units such that the on-demand printed information is not plainly visible on either side of the ticket as it exits the printer. Obscured and securely printed information is only revealed upon pealing or pulling back a designated perforated pull tab segment.

Printing units can be programmed to print designated locations and information such that each selectively printed zone is printed with corresponding information according to the receiving ink composition. The approach finds use to incorporate discrete encoded information such as security codes, barcodes, interactive color change elements, UV active sun sensitive elements, colored logos, artwork, metal embossed information and elements, and re-generating regions utilizing hysteresis inks and chemistries.

Secondary on-Demand Security Features

Visually clear or invisible UV stimulated elements can be included in on-demand secured printed articles. Invisible dyes can be included in printed examples thermal transfer/sublimation constructs. Security features can be exposed using hand-held long wave UV light (254 to 365 nanometers or above). The feature provides for anti-counter-fitting features, and secondary security applications. Exemplary fluorescence energy transfer dyes and invisible dye can be obtained from commercial sources (Day-glo Company—see examples below).

| | PHANTOM PIGMENTS | | | | |
|---|---|---|---|---|---|
| | D034 | IPO-13 | IPO-15 | IPO-18 | IPO-19 |
| EMISSION COLOR | bright yellow | red | orange | green | blue |
| AVERAGE PARTICLE SIZE | coarse | 6 microns | 4.5 microns | 4.5 microns | 5.8 microns |
| BODY COLOR | slight yellow tint | slight yellow tint | white | white | white |
| EMISSION WAVELENGTH (nm) | 507 | 620 | 590 | 530 | 450 |
| EXCITATION WAVELENGTH (nm) | 365 | 365 | 365 | 254 | 365 |
| SPECIFIC GRAVITY | 1.02 | 5.2 | 4.1 | 4.0 | 4.1 |

Segmented Multi-Element on-Demand Secured Printed Articles

Selectively located and sequestered regions of active ink components can be positioned within an article such that each selective zone or region has a distinct physical, optical, electrical, or alternately sensitized property that can be separately addressed during the on-demand printing process.

By way of example, the obscuring layer can be selectively printed in line on intended the inner side of a construct such that one or more functional ink types are located relative to one another. Various optical agents including, but not limited to: powdered dyes, liquid concentrated dyes, pigmented dyes, thermochromic reversible pigmented dyes thermochromic irreversible dyes, hysteresis thermochromic dyes, invisible security dyes, various colored food FD&C dyes, fluorescent dyes, carbon based dyes, glow-in-the-dark compounds, polydiacetylenic dyes, diacetylenic monomeric compounds, IR sensitive dyes, photochromic dyes, metal flake, glitter, optical pigments, color developers, and color formers can be selectively formulated in to ink compositions and printed within an on-demand secured printing document.

Secured on-Demand Initiated Time and Time-Temperature Indicators

Time and time-temperature indicators can be generated on demand by coating the inner side of an obscuring layer or transparent outer layer with one member of an optically reactive pair whereas a second element of a reactive pair is coated on the apposing substrate layer that accepts the transfer of the first pair during an on-demand printing process. As the thermal printing process occurs, one member of a reactive pair is transferred and put in intimate contact with the second pair member. Direct thermal and thermal transfer printing processes have the advantage of creating a melting transition between the pair members such that a triggering event can give rise to a physical, electrical, optical, or chemical process. Simple touch contact between printed layers can be sufficient to induce the process initiation step.

On-Demand Printing Initiated Reactive Mediums

Embodiments of the subject invention provide for the physical chemical transformation resulting in a transfer from one state to and second state and optional physical transfer from one physical position to a second. Printing may be used to induce or trigger a mechanical, optical, electrical or chemical state change that can further facilitate, propagate, or catalyze a more extensive change or impact in a printed on-demand secured article.

Slide Tab and Animated on-Demand Printed Articles

Other embodiments use a thermal transfer film with minimal relative translation (slide) to expose background color compared with thermal transfer area. White, colored, fluorescent, and other background colorations can be used. Thermal transfer film is preferably clear or translucent so contrast can be viewed between the ink that is transferred and the thermal transfer medium from which the ink is transferred. Sliding or laterally moving the imprinted image relative to the region of the cleared image region generated by the thermal sublimation transfer results in an image shadowing effect that provides for simple irreversible imaging of the imprinted information. On-demand printed images, information, graphics and the like can be reversibly exposed on an as needed basis.

In another format, on-demand secured printed articles can be combined with other visualization approaches such as those described by Seder in U.S. Pat. No. 7,151,541. Beyond the suggestions of Sender, animated visual sequences can be printed on-demand using the invention and constructs described herein. Tickets, greeting cards, documents, educational information, sequential information, instructional information and the like can be generated in animated formats on-demand rather than only mass printed in books and other repetitive printing processes.

Two-Ply Constructs for On-Demand Printing

Figure 1:
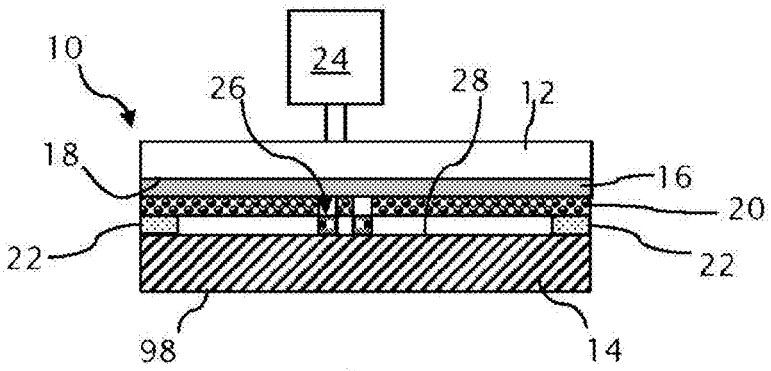
FIG. 1 is a cross-sectional view of a construct in accordance with one embodiment of the invention.
Figure 2:
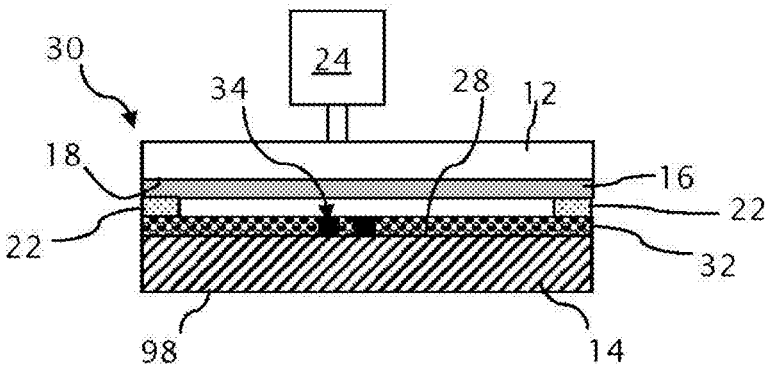
FIG. 2 is a similar cross-sectional view of a construct in accordance with another embodiment of the invention.
Figure 3:
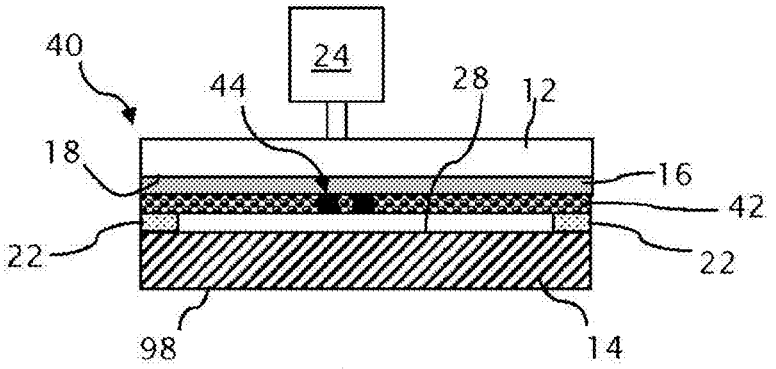
FIG. 3 is a similar cross-sectional view of a construct in accordance with yet another embodiment of the invention.
Figure 4:
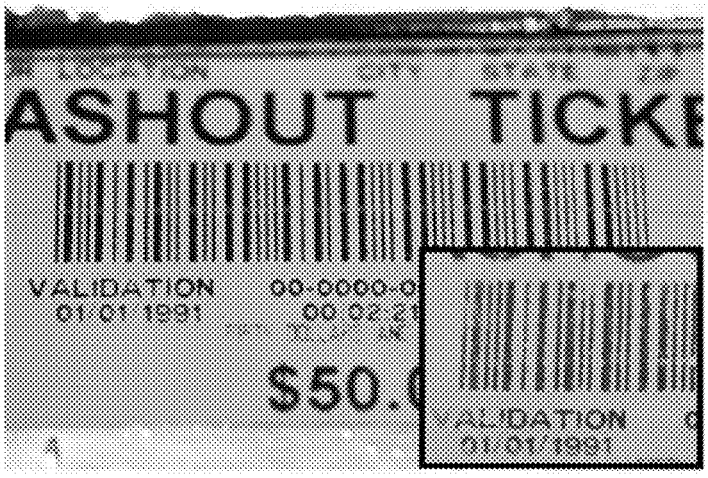
FIG. 4 is a grayscale reproduction of an image showing Example 1 as discussed in the specification.
Figure 5:
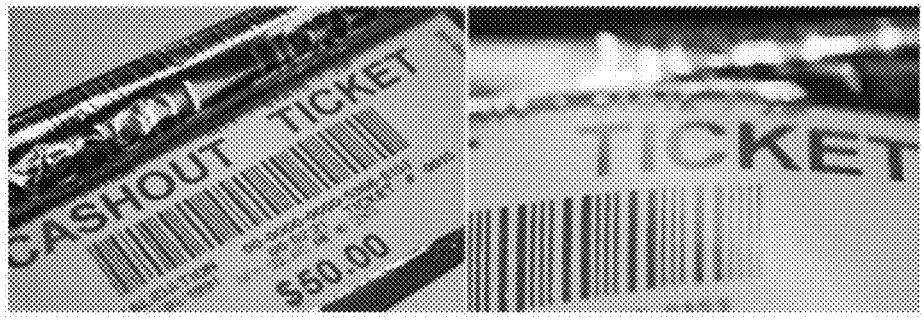
FIG. 5 is a grayscale reproduction of an image showing Example 4 as discussed in the specification.
Figure 6:
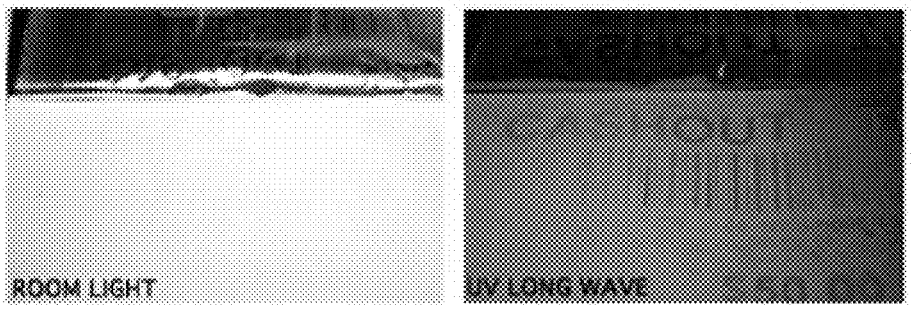
FIG. 6 is a grayscale reproduction of an image showing Example 7 as discussed in the specification.
Figure 7:
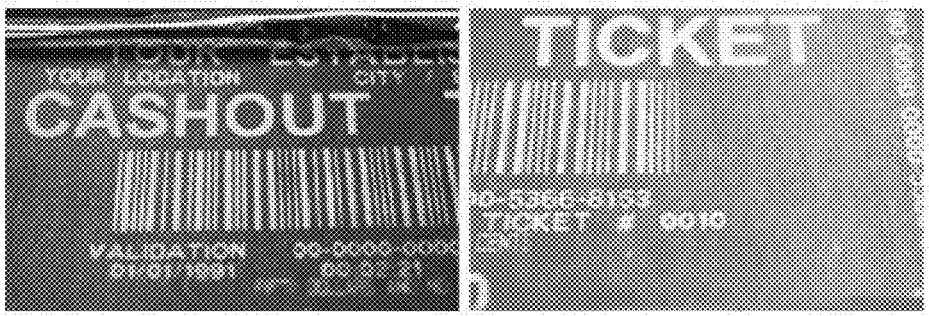
FIG. 7 is a grayscale reproduction of an image showing Example 8 as discussed in the specification.
Figure 8:
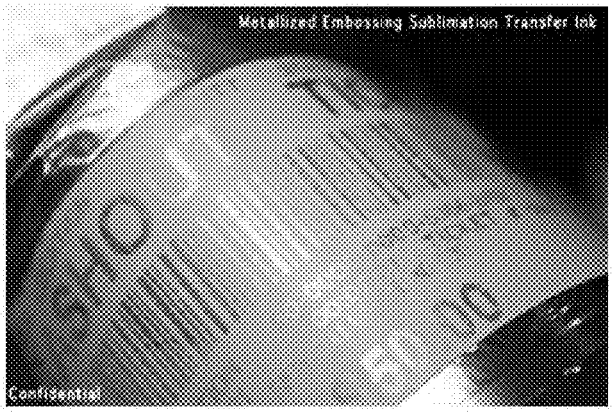
FIG. 8 is a grayscale reproduction of an image showing Example 9 as discussed in the specification.
Figure 9:
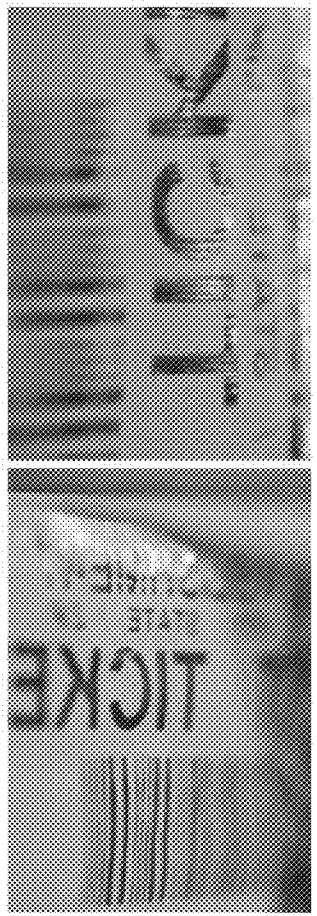
FIG. 9 is a grayscale reproduction of an image showing Example 11 as discussed in the specification.

Three embodiments of the invention are shown in FIGS. 1-3 as two-ply constructs 10, 30, and 40 arranged for on-demand printing of hidden or protected surfaces. The construct 10, shown in FIG. 1, has a thermally transmissive substrate 12, such as a Mylar film, and a second, e.g., paper, substrate 14. The thermally transmissive substrate 12 carries or otherwise includes a metallized layer 16 on a bottom surface 18, which renders the thermally transmissive substrate 12 opaque. The second substrate 14 is generally opaque but can be printed or otherwise coated to assure requisite opacity. The metallized layer 16 is preferably oriented adjacent to the second substrate 14 so that the metallized layer 16 is protected from exposure to the ambient environment. A sublimation transfer layer 20 is also carried by the thermally transmissive substrate 12 as a coating on the metallized layer 16. A patterned adhesive 22 temporarily bonds the two substrates 12 and 14 together. As shown, the patterned adhesive 22 is layered against the sublimation transfer layer 18 but could also be bonded more closely to the substrate 12 through gaps in the sublimation transfer layer 20 or the metallized layer 16.

During use, a thermal print head 24 applies localized heat and pressure normal to the thermally transmissive substrate 12, which is sufficiently thermally conductive to transfer a pixilated or other information bearing pattern of ink 26 from the sublimation transfer layer 20 to a top surface 28 of the second substrate 14. Because of the opaque natures of the two substrates 12 and 14, the printed information pattern 26 on the top surface 28 of the second substrate 14 remains hidden from view. However, the adhesive bond provided by the patterned adhesive 22 can be broken, such as by separating the patterned adhesive 22 from either substrate 12 or 14 or within itself, to remove the film substrate 12 and expose the printed information pattern 26 for viewing. The separation permanently breaks the adhesive bond and preferably damages or otherwise alters the appearance of one or both substrates 12 and 14 as evidence that the two substrates 12 and 14 have been separated.

A similar two-ply construct 30 shown in FIG. 2 includes corresponding structural layers designated by the same reference numerals as applied to the corresponding structures in the construct 10 of FIG. 1 but includes a thermochromic layer 32 for printing in place of the sublimation transfer layer 20. The thermochromic layer 32 is carried on the top surface 28 of the second substrate 14.

During use, the thermal print head 24 applies localized heat and pressure that is transmitted through the thermally transmissive substrate 12 including the metallized layer 16 to the thermochromic layer 32 for activating corresponding local areas 34 of the thermochromic layer 32. The activated areas 34 of the thermochromic layer 32, which can be formed in predetermined information bearing patterns, undergo a color change, which can be permanent or temporary depending on the objectives for the construct 10. Although initially hidden from view, the printed information pattern within the color changed areas 34 can be exposed for viewing by separating the film and paper substrates 12 and 14 as described above.

Another two-ply construct 40 shown in FIG. 3 is similar to the constructs 10 and 30 references corresponding structures with like reference numerals, but affixes a thermochromic layer 42 to the metallized layer 16 on the bottom surface 18 of the film substrate 12 instead of to the top surface 28 of the paper substrate 14. The thermal print head 24 operating through the film substrate 12 and metallized layer 16 forms printed information patterns 44 of color change in the thermochromic layer 42. Upon separating the film and paper substrates 12 and 14, as described above, the printed patterns 44 are rendered visible on the bottom surface 18 of the film substrate 12.

Although the two substrates 12 and 14 are described as film and paper, the two substrates 12 and 14 can each be made of a variety of other materials, as described above, or even the same materials. However, the substrate 12 is preferably sufficiently thermally transmissive so that a conventional thermal printer is operative for forming printed images on one or both of the interior surfaces of the substrates 12 or 14. A heat responsive layer for forming the printed images is preferably located so as to be positioned in thermal contact with the thermally transmissive substrate 12 during printing so that the desired printed pattern is transferred accurately and efficiently. Both substrates 12 and 14 are preferably sufficiently opaque or rendered sufficiently opaque so that the printed images remain hidden from view until the two substrates 12 and 14 are separated.

Although not shown, one or more coatings can be applied to the front surface of the substrate 12 for such purposes as reducing static buildup or reducing friction or binding contact with the thermal print head. One or both sides of either or both substrates 12 or 14 can be press printed during assembly in advance of the intended thermal printing during use. In addition, the substrates can be printed or engraved with security patterns for purposes of authentication or confusion patterns to resist candling, enhance effective opacity, or obscure any traces of thermal printing.

Particularly when the printed information patterns 26 or 34 are printed on the substrate 14 adjacent to the thermally transmissive substrate 12, the patterned adhesive 22 is preferably applied to the margin of the areas intended (i.e., designated) for thermal printing on the substrate 14 to avoid blocking or otherwise inhibiting the intended transfers of heat. In contrast, the patterned adhesive 22 can be flood coated when the printed information pattern 44 resides on the thermally transmissive substrate 12. However, some form of release or deadening agent is preferably used in the vicinity of the printed information pattern 44 to avoid damaging the pattern 44 when separating the two substrates 12 and 14. Preferably, the marginally applied patterned adhesive 22 includes gaps for allowing the escape of air during lamination of the two substrates 12 and 14 or subsequent thermal printing. Gaps in the patterned adhesive 22 can also be used to provide areas where the two substrates 12 and 14 can be separately gripped for relatively retracting or otherwise separating the two substrates 12 and 14 to reveal the hidden thermally printed information patterns 26, 34, or 44. Die cuts through one or the other substrates 12 or 14, particularly the substrate that holds the thermally printed image, can be used to form tabs in regions where the two substrates 12 and 14 are bonded together to provide another way to grip and relatively retract or otherwise separate the two substrates 12 and 14.

The invention, as it may be embodied in various forms, will also be understood from the examples presented below.

EXAMPLE 1

Simple Pull Tab and Slot Ticket Samples

Pull tab and slot ticket samples with secured on-demand printed information were prepared using a 25 gage metallized PET film secured with a dual stick adhesive strip to each side to structure. The metallized PET film was adhered to a 2.5 inch by 6 inch selected direct thermal print paper (Kanzaki, Appleton, Green Bay Packaging, Fasson, or other commercial suppliers). The layered structure was thermally printed on the metallized film side such that the actual printed information was obscured by the metallized film. When the construct was delaminated, the thermally printed information was revealed at good visual resolution matching that of standard thermal printing done in the absence of a thin obscuring layer.

EXAMPLE 2

Comparative Direct Thermal Substrate Reactivity Comparison

Pull tab examples and slot ticket samples with secured on-demand printed information were prepared using a 25 gage metallized PET film secured with a dual stick adhesive strip to each side to structure. The metallized PET film was adhered to a 2.5 inch by 6 inch direct thermal print papers (Kanzaki item numbers 4009, 4014, and 5055). The layered structure was thermally printed on the metallized film side such that the actual printed information was obscured by the metallized film. When the construct was delaminated, the thermally printed information was revealed at good visual resolution matching that of standard thermal printing done in the absence of a thin obscuring layer for item number 4009. Item numbers 4015 and 5055 gave inferior print quality with unreadable bar codes.

EXAMPLE 3

Natural Medium or Sublimation/Transfer Ink Formulation

A natural medium for thermal sublimation transfer on-demand secured printing articles was prepared using micro-emulsions of carnauba wax. Carnauba wax mediums were either prepared in a concentrated form for single coat applications used for printing or in lower concentration solid forms for multi-coat printing applications. By way of example, Michelman carnauba dispersions were obtained from Michelman Corp. ML156, a low solids formulation (25%) was used for multi-coat applications (2-4 coats) to ensure adequate transfer thicknesses. ML156 was also concentrated to 50% volume by continuous stirring and forced air flow. Concentrated natural sublimation/transfer mediums were prepared at 50% by volume solids. Concentrated ML156 formulations were used for single-coat applications. Likewise, pre-concentrated formulations could be prepared with 35% solids using ML156HS and ML160HS at 50% solids.

Aqueous carnauba dispersions were practical to be used directly with various optical agents including, but not limited to: powdered dyes, liquid concentrated dyes, pigmented dyes, thermochromic reversible pigmented dyes thermochromic irreversible dyes, hysteresis thermochromic dyes, invisible security dyes, various colored food FD&C dyes, fluorescent dyes, carbon based dyes, glow-in-the-dark compounds, polydiacetylenic dyes, diacetylenic monomeric compounds, IR sensitive dyes, photochromic dyes, metal flake, glitter, optical pigments, color developers, and color formers.

Sublimation transfer ink formulations were made by homogenizing an optical agent listed above from between 5% and 25% by weight in an aqueous micro-emulsion such as ML156, ML156 concentrated by 50%, ML156HS, or ML160HS. Mixtures were made uniform using aggressive agitation for 30 minutes at room temperature. Surfactants could be added up to 1% in the event that certain optical agents were difficult to directly disperse in the micro-emulsion. Homogeneously mixed inks were ready for use after adequate dispersion or could be stored under ambient conditions as required.

EXAMPLE 4

High Resolution on-Demand Secured Sublimation/Transfer Pull-Tab Tickets Using FD&C Red Number 3 and Metallized Obscuring Layer for Transfer An on-demand secured sublimation/transfer pull-tab ticket was prepared using an ink formulation described above in Example 3. Natural medium or sublimation/transfer ink formulation. FD&C red dye number 3 (Sensient Technologies, Inc.) was mixed with 50% concentrated aqueous dispersed carnauba (ML156 Michelman, Inc.). Red dye 3 was added at 15% by weight and mixed thoroughly to a semi-viscous ink.

Metallized polyester films (48 gage from Printpack Corp., 48 gage from CPFilms Crop., or 25 gage from Fasson North America) was printed using an equivalent 18 anilox roller on the aluminized side of the metallized film. Uniform print coating coloration was achieved. Upon in-line drying, the metallized layer was slit to size and laminated to a thin white semi-gloss paper stock such that the red sublimation/transfer ink was facing inward overlaying the semi-gloss side of the paper substrate (20 pound semi-gloss paper, Green Bay Packaging Corp.). Lamination was achieved along the edges of the construct such that the main body center of the construct was layered with a minor air gap but not directly adhered. Dual stick adhesive strips were applied in-line during production only along the edges of the upper metallized film layer and tacking to the lower acceptance substrate. Adhesives or specialized adherent substrates were not necessary for the purpose of sublimation/transfer or to enable this invention. Adhesives were only used in the construct for the purpose of attaching the obscuring transfer film to the underlying accepting substrate.

On-demand secured printing pull tab tickets were trimmed to 2.5 inches in width and between 2.5 and 6 inches in length. The exact length of the articles was dependent on the ticket application of interest. Regions of release and location to "pull and delaminate" the ticket post printing were accomplished using perforated dies in line on the printing press. Between ticket perforations were accomplished in-line for the purpose of separating each ticket from the printer and for use post printing. Periodic registration marks were printed on the outer surface of the paper layer along with standard and/or customized graphics. The registration marks were standardized for compatibility with the thermal printer model of interest.

On-demand secured printed information was printed on assembled pull tab tickets using commercially available thermal printing units and software command language controlling the printer. Ticket examples were printed such that the metallized film layer side to the ticket came in direct contact with the thermal print head unit during printing. The paper side entered the printer face up with registration marks and customized graphics visually face up. Printed tickets were successfully printed with commercial printing units such that the on-demand printed information was not plainly visible on wither side of the ticket as it exited the printer. Obscured and securely printed information was only revealed upon pealing or pulling back a designated perforated pull tab segment.

EXAMPLE 5

Interactive on-Demand Secured Sublimation/Transfer Pull-Tab Tickets Using FD&C Red Dye 3 and Reversible Thermochromic Touch Sensitive Pigments An interactive on-demand secured sublimation/transfer pull-tab ticket was prepared using an ink formulation described above in Example 3 modified with 2% by weight 25° C. blue thermochromic leuco dye (Segan Industries, Inc.). Natural medium or sublimation/transfer ink formulation. FD&C red dye number 3 (Sensient Technologies, Inc.) was mixed with 50% concentrated aqueous dispersed carnauba (ML156 Michelman, Inc.). Red dye 3 was added at 15% by weight and mixed thoroughly to a semi-viscous ink. Blue thermochromic pigment powder (5 micron mesh size) was mixed and milled into the ink base.

Interactive on-demand secured printed tickets were printed and assembled as described above in Example 4, On-demand secured sublimation/transfer pull-tab tickets using FD&C red number 3, a blue thermochromic leuco dye, and metallized obscuring layer for transfer.

Interactive on-demand secured printed information was printed on assembled pull tab tickets using commercially available thermal printing units and software command language controlling the printer. Ticket examples were printed such that the metallized film layer side to the ticket came in direct contact with the thermal print head unit during printing. The paper side entered the printer face up with registration marks and customized graphics visually face up. Printed tickets were successfully printed with commercial printing units such that the on-demand printed information was not plainly visible on wither side of the ticket as it exited the printer. Obscured and securely printed information was only revealed upon pealing or pulling back a designated perforated pull tab segment. The in addition to visual appeal of an initial purple printed image, the image could interactively be induced to change color to a red coloration reversibly due to the thermochromic nature of the added element. In addition to interactivity, thermochromic element provided an additional security feature to prevent fraudulent duplication of a winning ticket.

EXAMPLE 6

Interactive on-Demand Secured Sublimation/Transfer Pull-Tab Tickets Using FD&C Yellow Dye 5 and Reversible Photochromic UV Sensitive Pigment An interactive on-demand secured sublimation/transfer pull-tab ticket was prepared using an ink formulation described above in Example 3 modified with 2% by weight blue photochromic dye (Segan Industries, Inc.). Natural medium or sublimation/transfer ink formulation. FD&C yellow dye number 5 (Sensient Technologies, Inc.) was mixed with 50% concentrated aqueous dispersed carnauba (ML156 Michelman, Inc.). Blue reversible photochromic pigment powder (5 micron mesh size) was mixed and milled into the ink base.

Interactive on-demand secured printed tickets were printed and assembled as described above in Example 4, On-demand secured sublimation/transfer pull-tab tickets using FD&C yellow number 5, a blue photochromic dye, and metallized obscuring layer for transfer.

Interactive on-demand secured printed information was printed on assembled pull tab tickets using commercially available thermal printing units and software command language controlling the printer. Ticket examples were printed such that the metallized film layer side to the ticket came in direct contact with the thermal print head unit during printing. The paper side entered the printer face up with registration marks and customized graphics visually face up. Printed tickets were successfully printed with commercial printing units such that the on-demand printed information was not plainly visible on wither side of the ticket as it exited the printer. Obscured and securely printed information was only revealed upon pealing or pulling back a designated perforated pull tab segment. The in addition to visual appeal of an initial yellow printed image, the image could interactively be induced to change color reversibly to a green color out doors due to the photochromic nature of the added element. In addition to interactivity, photochromic element provided an additional security feature to prevent fraudulent duplication of a winning ticket.

EXAMPLE 7

Dual Security on-Demand Sublimation/Transfer Pull-Tab Tickets Using an Invisible UV Activated Fluorescent Dye A dual on-demand secured sublimation/transfer pull-tab ticket was prepared using an ink formulation described above in Example 3 modified with 10% by weight invisible UV activated fluorescent dye (IPO-15 Day Glo Crop.) in the natural medium or sublimation/transfer ink formulation. The invisible security pigment was mixed with 50% concentrated aqueous dispersed carnauba (ML156 Michelman, Inc.). Dual security on-demand printed tickets were printed and assembled as described above in Example 4.

Interactive on-demand secured printed information was printed on assembled pull tab tickets using commercially available thermal printing units and software command language controlling the printer. Ticket examples were printed such that the metallized film layer side to the ticket came in direct contact with the thermal print head unit during printing. The paper side entered the printer face up with registration marks and customized graphics visually face up. Printed tickets were successfully printed with commercial printing units such that the on-demand printed information was not plainly visible on wither side of the ticket as it exited the printer. Obscured and securely printed information was only exposed upon pealing or pulling back a designated perforated pull tab segment, however the printed information was not visualized unless further exposed by radiation with a hand-held long wave UV light. Sublimation transferred graphics were only transiently visible during expose and instantly extinguished when the light was removed even in normal room light. The invisible fluorescent dye provided an additional security feature to prevent fraudulent duplication as well as highly protected secured information.

EXAMPLE 8

High Resolution on-Demand Secured Hysteresis Ink Printed Articles

An on-demand secured hysteresis ink articles were prepared using semi-irreversible hysteresis described above or purchased from a commercial source (Thermolock, Matsui International). Hysteresis inks provide the advantages of high resolution, ease of printing, multiple color types (e.g. black, blue, orange, pink, magenta and combinations thereof), and the ability of images to be erased by chilling or full heating at any desirable time after printing. Likewise, they can be utilized in reprinting formats.

On-demand secured printed articles were made using methods and materials described above in Example 4 High resolution on-demand secured sublimation/transfer pull-tab tickets using FD&C red number 3 and metallized obscuring layer for transfer.

Hysteresis inks (black and orange) were printed on an acceptable paper substrate (20 pound semi-gloss paper, Green Bay Packaging Corp.) using an equivalent 18 anilox roller on the apposing side of an opaque obscuring film in the laminate. Opaque obscuring films can include, but are not limited to metallized polyester films (48 gage from Printpack Corp., 48 gage from CPFilms Crop., or 25 gage from Fasson North America).

Lamination between the obscuring layer and the apposing hysteresis ink printed substrate was achieved along the edges of the construct such that the main body center of the construct was layered with a minor air gap but not directly adhered. Dual stick adhesive strips were applied in-line during production only along the edges of the upper metallized film layer and tacking to the lower acceptance substrate. Adhesives or specialized adherent substrates were not necessary for the purpose of sublimation/transfer or to enable this invention. Adhesives were only used in the construct for the purpose of attaching the obscuring transfer film to the underlying accepting substrate.

On-demand secured printing articles were trimmed to of interest. Regions of release and location to "pull and delaminate" the ticket post printing were accomplished using perforated dies in line on the printing press. Between ticket perforations were accomplished in-line for the purpose of separating each ticket from the printer and for use post printing. Periodic registration marks were printed on the outer surface of the paper layer along with standard and/or customized graphics. The registration marks were standardized for compatibility with the thermal printer model of interest.

On-demand secured printed information was printed on assembled article using commercially available thermal printing units and software command language controlling the printer. Examples were printed such that the metallized film layer side to the ticket came in direct contact with the thermal print head unit during printing. The paper side entered the printer face up with registration marks and customized graphics visually face up. Printed tickets were successfully printed with commercial printing units such that the on-demand printed information was not plainly visible on wither side of the ticket as it exited the printer. Obscured and securely printed information was only revealed upon pealing or pulling back a designated perforated pull tab segment. Printed areas were imaged clear with respect to the unprinted and darker hysteresis ink areas.

EXAMPLE 9

On-Demand Sublimation/Transfer Silver Embossed Printing Method

An on-demand sublimation/transfer printed card was prepared using an ink formulation described above in Example 3 modified with 10% by aluminum metal flake (300 mesh aluminum powder) in a natural medium or sublimation/transfer ink formulation. The aluminum powder was mixed with 50% concentrated aqueous dispersed carnauba (ML156 Michelman, Inc.). The aluminum powder was added at 10% by weight and mixed thoroughly to a semi-viscous ink.

The on-demand printed cards were printed and assembled as described above in Example 4, On-demand secured sublimation/transfer pull-tab tickets using the aluminum powder and metallized obscuring layer for transfer.

The on-demand embossed card was printed using commercially available thermal printing units and software command language controlling the printer. Various card examples were printed such that the metallized film layer side to the ticket came in direct contact with the thermal print head unit during printing. The paper side entered the printer face up with registration marks and customized graphics visually face up. Printed cards were successfully printed with commercial printing units such that the on-demand printed information was not plainly visible on wither side of the ticket as it exited the printer. Obscured and embossed information was revealed upon pealing or pulling back a designated perforated pull tab segment.

EXAMPLE 10

On-Demand Secured Printed Articles Using Irreversible Tunable Polymeric Inks On-demand secured printed articles were made using methods and materials described above in Example 4 High resolution on-demand secured sublimation/transfer pull-tab tickets using FD&C red number 3 and metallized obscuring layer for transfer.

Pre-polymerized ink formulations were prepared in aqueous ink vehicles. Aqueous ink formulations had the benefit of avoiding undesirable volatile solvents that most result in environmental concerns upon evaporation. Pre-polymerized aqueous ink are prepared by emulsifying monomeric diacetylenic compositions either in the crystalline state to a microparticulate state or by forming an oil phase above the melting transition of the monomer and aggressively mixing the composition to a stable micro-emulsion form.

In the current example, 10,12-tricosadiynoic acid (30 gram) in powder form was added to an aqueous flexographic printing vehicle (220 grams Thermostar aqueous binder) along with water (40 grams) and mixed at room temperature. The mixture was brought to 180° F. and aggressively emulsified at high speed using a rotostator mixer (Omni brand). The emulsion formed a uniform fluid past. The paste was agitated and allowed to cool to room temperature where it thickened into a viscous ink. The monomeric ink could be printed directly on semi-gloss 20 pound paper (Green Bay Packaging) using a 18 anilox equivalent roller and the print area allowed to dry. The printed regions were polymerized to a uniform blue coloration using a 254 nanometer UV lamp.

Aqueous vehicles can be selected for particular applications depending on their utility and compatibility with particular diacetylenic monomeric compounds. Upon adequate emulsification and particle sizing, the diacethylenic composition can be polymerized by using 254 nanometer ultraviolet light from a colorless to an enriched blue coloration typical and indicative of the polydiacetylene polymerization reaction. Alternatively, polymerization can be accomplished by using a gamma irradiation source of other compatible high-energy source such as cobalt 60.

Lamination between an obscuring metallized polyester film (48 gage, PrintPack Corp.) was achieved along the edges of the construct such that the main body center of the construct was layered with a minor air gap but not directly adhered. Dual stick adhesive strips were applied in-line during production only along the edges of the upper metallized film layer and tacking to the lower acceptance substrate. Adhesives or specialized adherent substrates were not necessary for the purpose of sublimation/transfer or to enable this invention. Adhesives were only used in the construct for the purpose of attaching the obscuring transfer film to the underlying accepting substrate.

On-demand secured printing articles were trimmed to 2.5 inches in width and between 2.5 and 6 inches in length. The exact length of the articles was dependent on the ticket application of interest. Regions of release and location to "pull and delaminate" the ticket post printing were accomplished using perforated dies in line on the printing press. Between ticket perforations were accomplished in-line for the purpose of separating each ticket from the printer and for use post printing. Periodic registration marks were printed on the outer surface of the paper layer along with standard and/or customized graphics. The registration marks were standardized for compatibility with the thermal printer model of interest.

On-demand secured printed information was printed on assembled articles using commercially available thermal printing units and software command language controlling the printer. Ticket examples were printed such that the metallized film layer side to the ticket came in direct contact with the thermal print head unit during printing. The paper side entered the printer face up with registration marks and customized graphics visually face up. Printed tickets were successfully printed with commercial printing units such that the on-demand printed information was not plainly visible on wither side of the ticket as it exited the printer.

EXAMPLE 11

On-Demand Secured Printed Articles Using Irreversible Pigmented Inks Printed on Inner Surface of Obscuring Film On-demand secured printed articles were made using methods and materials described above in Example 4 High resolution on-demand secured sublimation/transfer pull-tab tickets using FD&C red number 3 and metallized obscuring layer for transfer.

Pigmented polymeric inks can be use with slightly thicker opaque obscuring films for printing on the back side of the obscuring film or with thin obscuring films for printing on the underlying substrate. Commercially available irreversible pigmented thermochromic inks can be utilized in on-demand secured printed documents provided that the temperature transition, dynamic sensitivity and static sensitivities are suitable for the particular application of interest. Irreversible thermochromic inks can be sourced form commercial sources (e.g. Segan Industries, Inc. or Nucoat, Inc.) or prepared accordingly (Ribi, WO2008079357 A2) as well as other commercial sources.

Irreversible pigmented ink formulations were prepared in aqueous ink vehicles. Aqueous ink formulations had the benefit of avoiding undesirable volatile solvents that most result in environmental concerns upon evaporation. Irreversible thermochromic pigment inks with temperature transition at 45° C., 50° C., 55° C., and 60° C. were commercially purchased (Segan Industries, Inc.). Various color change compositions were utilized and tested including colorless to colored upon heating white to magenta, white to orange, white to turquoise, white to black, white to cyan, and white to red. Likewise, color to color compositions were formulated by adding water soluble aqueous FD&C dyes and fluorescent dyes that were complementary to the color change compound. Color to color selections included yellow to magenta, yellow to orange, yellow to green, green to magenta, blue to magenta, pink to purple, red to purple and a range of other color to color combinations.

Pigmented ink compositions were printed on the inner side of the obscuring layer using an 18 equivalent anilox draw down system. Examples were printed with single and multi-printed separated regions to provide for multi-colored image outputs. Binding resins were adjusted to promote adhesion of the irreversible ink to the inner surface of the obscuring layer and inhibit transfer or sublimation of the ink to the underlying substrate layer.

Lamination between the printed obscuring metallized polyester film (48 gage, PrintPack Corp.) was achieved along the edges of the construct such that the main body center of the construct was layered with a minor air gap but not directly adhered. Dual stick adhesive strips were applied in-line during production only along the edges of the upper metallized film layer and tacking to the lower acceptance substrate. Adhesives or specialized adherent substrates were not necessary for the purpose of sublimation/transfer or to enable this invention. Adhesives were only used in the construct for the purpose of attaching the obscuring transfer film to the underlying accepting substrate.

On-demand secured printing articles were trimmed to 2.5 inches in width and between 2.5 and 6 inches in length. The exact length of the articles was dependent on the ticket application of interest. Regions of release and location to "pull and delaminate" the ticket post printing were accomplished using perforated dies in line on the printing press. Between ticket perforations were accomplished in-line for the purpose of separating each ticket from the printer and for use post printing. Periodic registration marks were printed on the outer surface of the paper layer along with standard and/or customized graphics. The registration marks were standardized for compatibility with the thermal printer model of interest.

On-demand secured printed information was printed on assembled articles using commercially available thermal printing units and software command language controlling the printer. Ticket examples were printed such that the metallized film layer side to the ticket came in direct contact with the thermal print head unit during printing. The paper side entered the printer face up with registration marks and customized graphics visually face up. Printed tickets were successfully printed with commercial printing units such that the on-demand printed information was not plainly visible on either side of the ticket as it exited the printer.

Two-Ply Construct for On-Demand Thermal Printing and Method of Manufacture and Use Another embodiment of two-ply on-demand thermally printable construct 50 is shown in FIGS. 10A-E. The construct 50 is made with functionally opaque top and bottom plies 52 and 54 temporarily bonded together to obscure printed information 56 on the bottom ply 54, which is intended to be thermally printed on-demand during eventual use. The top ply 52 is a metallized film, preferably a 10 gage to 30 gage PET film 58, with 24 gage most preferred, and a metallized layer 60. The bottom ply 54 is preferably a conventional direct thermal printable paper comprising a paper substrate 62 and a thermochromic layer 64 forming a direct thermal printable medium positioned adjacent to the top ply 52. For example, the bottom ply 54 can be a direct thermal paper from Kanzaki Specialty Papers of Springfield, Mass. designated as TO-381N.

As shown in the front view of FIG. 10A, the top ply 52 covers only a portion of the bottom ply 54 along a top half of the bottom ply 54 so that the printed information 56 is hidden and additional printed information 66 (thermal or non-thermal) is visible (i.e., uncovered by the top ply 52) along a bottom half of the bottom ply 54. While the printing 66 can be applied during the initial assembly of the construct 50 as a part of a succession of such constructs on press, at least some of the printing 66 is preferably printed together with the hidden printing 56 by a thermal printer 80 in association with the on-demand dispensing and use of the individual construct 50.

The top ply 52 is affixed to the bottom ply 54 by an adhesive pattern 68 that includes (as particularly shown in FIG. 10C) broken rails 70 that extend along the length of the top ply 52 leaving gaps 72 along the rails 70 for allowing the escape of air during lamination or printing. The adhesive pattern 68 includes partial rails 74 at opposite ends with gaps 76 also allowing the escape of air. The two sets of rails 70 and 74, which follow the perimeter of the top ply 52, surround a space on the bottom ply 54 within which the hidden information 56 can be thermally printed. Notably, heat and pressure applied by the thermal printer 80 is transmissible directly through the top ply 52, as a thin metallized film, to the thermochromic layer 64 of the bottom ply 54 for printing the hidden information 56. Various adhesives can be used for forming the adhesive pattern, but in the present embodiment, the adhesive is preferably an air-cured water-based adhesive.

As shown in FIGS. 10C-E, corner tabs 82 and 84 are formed by serpentine die cuts 86 and 88 through the bottom ply 54. Both sets of glue rails 70 and 74 near the top end corners the bottom ply 54 underlie and bond the corner tabs 82 and 84 to the top ply 52. Following the on-demand thermal printing and dispensing of the construct 50, either or both the corner tabs 82 or 84 can be used to assist in the manual removal of the top ply 52 from the remainder of the bottom ply 54 to reveal the thermally printed hidden information 56 on the bottom ply 54. As shown in FIG. 10E, the serpentine patterns 86 and 88 further facilitate the separation by providing gripping points 90 on the remainder of the bottom ply 54 juxtaposed with the corner tabs 82 and 84.

The adhesive of the adhesive pattern 68 can be formulated to preferentially bond with either the metallized layer 60 of the top ply 52 or the thermochromic layer 64 of the bottom ply 54 such that the retraction of the top ply 52 from the bottom ply permanently alters the appearance of one or the other plies 52 or 54 so that the top and bottom plies 52 and 54 cannot be easily reassembled together without providing a visual indication of their prior separation. In addition or in the alternative, the adhesive pattern 68 is preferably no longer tacky after the plies 52 and 54 have been separated to inhibit reassembly and to provide more convenient handling of the bottom ply 54 for exploiting the revealed information 56 on the bottom ply 54.

Although the corner tabs 82 and 84 are formed at both ends of the bottom ply 54, a single tab at one corner or end of the bottom ply 54 can be provided for retracting the top ply 52. In place of either tab 82 and 84, a deadened area of the adhesive pattern 68 or an enlarged gap in the adhesive pattern 68 could provide assistance in support of manually retracting the top ply 52.

As shown in FIGS. 10A and 10E, a first confusion pattern 92 is formed in a top surface 94 of the film 58 and a second confusion pattern 96 is formed on a bottom surface 98 of the paper substrate 62. Both confusion patterns 92 and 96 protect the hidden information 56 from view prior to the separation of the top and bottom plies 52 and 54. The first confusion pattern 92 is preferably formed by embossing a pattern in the film 58 (e.g., hot stamping) to obscure any thermal traces left by the thermal printer 80 in the film 58 following the thermal printing of the hidden information 56. The application of heat and pressure by the thermal printer 80 can produce some localized stretching or shrinking of the film 58, which could provide some indication of the information 56 that was thermally printed. The embossed confusion pattern 92 provides similar localized effects over the area available for thermal printing so that any localized effects of the thermal printer 80 are not readily distinguishable or otherwise apparent.

Although the confusion pattern 92 is preferably written into the metalized film of the top ply 52 by hot stamping, other localized distortions mimicking or otherwise obscuring the effects of thermal printing through the top ply 52 can be performed by a variety of known means including mechanical, hydro-forming, and laser techniques.

The second confusion pattern 96 on the bottom surface 98 of the paper substrate 62 is preferably printed in the same color as the thermally printed information 56 to inhibit so-called "candling" in which light shown through the paper substrate 62 might otherwise make the printed information detectable 56. Similar to the embossed confusion pattern 92, the printed confusion pattern 96 covers the area available for thermal printing with more random character-like pattern that reduces background contrast to the printed information. Additional printing, such as instructional or identifying information 100 and a locating mark 102 can be printed separately or together with the second confusion pattern 96 on the bottom surface 98 of the paper substrate 62. The locating mark 102 can be used register each of a succession of constructs 50 to the thermal printer 80 during subsequent use.

The two-ply construct 50, similar to other such constructs described herein, is preferably assembled as a part of a succession of constructs along a web 110 as shown by example in FIG. 11. The constructs 50 are oriented end-to-end along the length of the web 110 and are arranged three-wide across the web 110. Of course, different orientations and arrangements are possible, but the orientation of the top ply 52 as lengths of continuous strips is considered efficient for the web format.

An in-line press 120 is depicted in FIG. 12 as an example of how on-demand printable constructs, such as the construct 50, can be assembled. A roll of thermal paper 122 is unwound and advanced through the press 120 as a first web 124. A first printer 126 prints the second confusion pattern 96 together with the instructional or identifying information 100 and a succession of locating marks 102 on the bottom surface of the thermal paper web 124. Since webs can be readily inverted on press, the orientation of the printer 126 beneath the thermal paper web 124 is presented merely for ease of illustration. A die cutter 128 provides the serpentine die cuts 86 and 88 cuts that define in part the corner tabs 82 and 84. An adhesive applicator 130 prints or otherwise applies the adhesive patterns 68 to the top surface of the thermal paper web 124.

A roll of metallized film 132 is unwound and advanced through the press 120 as a second web 134, which first encounters a heated embossing drum 136 for embossing the confusion pattern 92 in a top surface 94 of the metallized film web 134. A die cutter 138 slits the metallized film web 134 into strips 140, and a laminator 142 laminates the strips 140 to the top surface of the thermal paper web 124 in lateral registration with the adhesive patterns 68 for bonding the top and bottom plies 52 and 54 of the constructs together. The gaps 72 in the adhesive pattern 68 allow for the escape of air between the top and bottom plies 52 and 54 during the laminating process. Another die cutter 144 slits the combined metallized film strips 140 and thermal paper web 124 into successions of single-width on-demand printable constructs 50 that are wound on respective rolls 146 for delivery and eventual use.

Although the embossing (drum) and (die cutter) slitting stations 136 and 138 are shown as a part of the in-line press 120, these operations as well as others can be performed on one or more separate presses, and as such, the roll of metallized film 132 can be replaced by respective rolls of pre-embossed metallized film strips 140. The embossing drum 136, whether part of the in-line press 120 or another in-line press, preferably embosses the confusion pattern 92 using heat and pressure at least comparable to the heat and pressure of the thermal print head 80 with which the constructs 50 are intended for use. For example, a raised brass die of the embossing drum can be raised to a temperature of approximately 175 degrees Celsius. The separate in-line presses can each be operated at a different optimum speed for carrying out their respective operations.

The die cutter 144 can also be arranged for forming lines of perforation between the successive single-width constructs 50 to aid in their eventual separation. Instead of winding the succession of single-width constructs 50 into the rolls 146, a fan-folder can be used to fanfold equal numbers of one or more constructs 50 about the lines of perforation into stacks.

The rolls 146 or the stacks (not shown) can be delivered directly for use in on-demand thermal print stations or can be further processed into smaller rolls of stacks matching the magazine capabilities of the on-demand thermal print stations. For example, as shown in FIG. 13, a thermal print station 150 preferably includes in addition to a thermal printer 152, comparable to the thermal printer 80, an active interface 154, such as a graphic user interface, tied to a processor 156 for controlling the printing and dispensing of individual constructs 50. As shown, the thermal print station 150 also includes a magazine 158 for receiving one of the rolls 148 of single-width on-demand printable constructs 50 and a dispenser 160, which can include a cutter 162 or breaking bar for perforations, for dispensing one or more of the thermally printed constructs 50 to the user. Under command of the processor 156, which can be linked to a network or other source of information or command, the thermal printer 152 prints the hidden information 56 as generally unique data through the metallized film ply 52 as well as at least some of the other information 66 directly on the direct thermal paper ply 52. The direct thermally printed information 56 remains hidden on the direct thermal paper ply 52 until the metallized film ply 52 is at least partially removed as described above.

Although described with respect to a limited number of component variations, combinations and examples, those of skill in the ort will appreciate the many modifications and further developments that can be made for carrying out the invention. For example, the invention contemplates multi-element printing options including combining multiple thermally printable mediums for producing different optical effects that may be registered in line with a succession of constructs so that each construct includes a plurality of hidden optical effects. Color blocking and matching transparent films could be used for obscuring printed images. Cling substrates could be used to obviate adhesive. Other concepts that are useful in the context of the invention include diffusion of a reversers, diffusion of developers, ascending color development, locating the developer and color former on apposing layers, use of thermal induction for heat generation and signal development, inkjet diffusion through obscuring layer chemically triggering internally, pressure induction using carbonless inks, thickening agents including carboxy methyl cellulose (CMC) and Thixo™, color deadening using strong base composition transfer, paper obscuring transfer layers, identical apposing layers, transfer of interactive dye, securing opaque transfer layer to preserve and keep secret on-demand printed information, selective use of a range of dye compositions, and combinations with other printing technologies including but not limited to inkjet, dye sublimation, direct thermal, and indirect thermal laser.

The following are remarks concerning the reading of the above text. This invention is not limited to particular embodiments described and, as such may, of course, vary. Where a range of values is provided, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges and are also encompassed within the invention, subject to any specifically excluded limit in the stated range. Where the stated range includes one or both of the limits, ranges excluding either or both of those included limits are also included in the invention.

Certain ranges are presented herein with numerical values being preceded by the term "about." The term "about" is used herein to provide literal support for the exact number that it precedes, as well as a number that is near to or approximately the number that the term precedes. In determining whether a number is near to or approximately a specifically recited number, the near or approximating unrecited number may be a number which, in the context in which it is presented, provides the substantial equivalent of the specifically recited number.

Unless defined otherwise, all technical and scientific terms used herein have the same meaning as commonly understood by one of ordinary skill in the art to which this invention belongs. All publications and patents cited in this specification are herein incorporated by reference as if each individual publication or patent were specifically and individually indicated to be incorporated by reference and are incorporated herein by reference to disclose and describe the methods or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual publication dates which may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. Any recited method can be carried out in the order of events recited or in any other order, which is logically possible.

The invention claimed is:

1. An on-demand printable construct comprising first and second substrates straddling a thermally printable medium, a bonding agent that secures the substrates together enclosing the thermally printable medium between the two substrates, the thermally printable medium including an area designated within the construct for thermal printing through the first substrate, and the bonding agent being excluded from overlapping with the designated area of the thermally printable medium arranged within the construct for thermal printing.

2. The construct of claim 1 in which the two substrates are opaque for blocking visual access to the designated area of the thermally printable medium arranged within the construct for thermal printing.

3. The construct of claim 1 in which the first substrate is a thermally transmissive substrate for thermally printing within the designated area of the thermally printable medium through the thermally transmissive substrate.

4. The construct of claim 3 in which the thermally printable medium is a transfer/sublimation medium carried by the first substrate and the second substrate is arranged to capture ink thermally transferred or sublimated from the transfer/sublimation medium.

5. The construct of claim 3 in which the thermally printable medium is a thermochromic medium carried by the second substrate.

6. The construct of claim 3 in which the first substrate is retractable in a manner that evidences its retraction for revealing the thermally printed material otherwise hidden between the substrates.

7. An on-demand printable construct comprising top and bottom plies straddling a thermally printable medium, a bonding agent that secures the plies together enclosing the thermally printable medium between the two plies, the top ply being thermally transmissive, the thermally printable medium being located adjacent to the top ply so that the top ply and the thermally printable medium are in direct contact during thermal printing through the top ply, and the bonding agent being arranged in a pattern around a margin of an area within which the top ply and thermally transmissive medium contact during thermal printing.

8. The construct of claim 7 in which gaps are formed in the pattern of the bonding agent to allow air to escape from between the top and bottom plies during lamination of the two plies together with the bonding agent.

9. The construct of claim 7 in which the thermally printable medium is a thermochromic medium carried by the top ply.

10. The construct of claim 7 in which the thermally printable medium is a thermochromic medium carried by the bottom ply.

11. The construct of claim 7 in which the top ply is relatively retractable from the bottom ply in a manner that evidences its retraction for revealing the thermally printed material otherwise hidden between the plies.

12. The construct of claim 11 in which one of the top and bottom plies is die cut for separating an area of the top and bottom plies that is bonded together for use as a tab to aid in the relative retraction of the top ply.

13. An on-demand printable construct comprising top and bottom plies straddling a thermally printable medium, a bonding agent that secures the plies together enclosing the thermally printable medium between the two plies, the top ply being thermally transmissive, the thermally printable medium being located adjacent to the top ply so that the top ply and the thermally printable medium are in direct contact during thermal printing through the top ply, the top ply being a metalized film, and the metalized film including a film with a metallized layer oriented adjacent to the thermally printable medium.

14. The construct of claim 13 in which the thermally printable medium is a thermochromic medium carried by the bottom ply and the top ply is relatively retractable from the bottom ply in a manner that evidences its retraction for revealing the thermally printed material otherwise hidden between the plies.

15. The construct of claim 14 in which one of the top and bottom plies is die cut for separating an area of the top and bottom plies that is bonded together for use as a tab to aid in the relative retraction of the top ply.

16. An on-demand printable construct comprising top and bottom plies straddling a thermally printable medium, a bonding agent that secures the plies together enclosing the thermally printable medium between the two plies, the top ply being thermally transmissive, the thermally printable medium being located adjacent to the top ply so that the top ply and the thermally printable medium are in direct contact during thermal printing through the top ply, the top ply being a metalized film, and a confusion pattern being embossed in the metalized film of the top ply.

17. The construct of claim 16 in which the thermally printable medium is a thermochromic medium carried by the bottom ply and the top ply is relatively retractable from the bottom ply in a manner that evidences its retraction for revealing the thermally printed material otherwise hidden between the plies.

18. The construct of claim 17 in which one of the top and bottom plies is die cut for separating an area of the top and bottom plies that is bonded together for use as a tab to aid in the relative retraction of the top ply.

19. An on-demand printable construct comprising top and bottom plies straddling a thermally printable medium, a bonding agent that secures the plies together enclosing the thermally printable medium between the two plies, the top ply being thermally transmissive, the thermally printable medium being located adjacent to the top ply so that the top ply and the thermally printable medium are in direct contact during thermal printing through the top ply, and the thermally printable medium being a transfer/sublimation medium carried by the top ply and the bottom ply is arranged to capture ink thermally transferred or sublimated from the transfer/sublimation medium.

20. The construct of claim 19 in which the top ply is relatively retractable from the bottom ply in a manner that evidences its retraction for revealing the thermally printed material otherwise hidden between the plies.

21. The construct of claim 20 in which one of the top and bottom plies is die cut for separating an area of the top and bottom plies that is bonded together for use as a tab to aid in the relative retraction of the top ply.

* * * * *

UNITED STATES PATENT AND TRADEMARK OFFICE

CERTIFICATE OF CORRECTION

PATENT NO. : 8,546,301 B2
APPLICATION NO. : 13/158396
DATED : October 1, 2013
INVENTOR(S) : Hans O. Ribi and Chauncey T. Mitchell, Jr.

It is certified that error appears in the above-identified patent and that said Letters Patent is hereby corrected as shown below:

In the Specification:

In column 2, line 37, "between the adhesive the" should read --between the adhesive and the--.
In column 3, at the end of line 52, "one the" should read --one of the--.
In column 3, at the end of line 54, "with" should read --which--.
In column 4, at the beginning of line 13, "at later" should read --at a later--.
In column 5, line 2, "embodiment" should read --embodiments--.
In column 5, line 27, "a highly opaque films" should read --a highly opaque film--.
In column 7, line 9, "where as" should read --whereas--.
In column 7, line 43, "a thermal print heads" should read --a thermal print head--.
In column 8, line 9, "utilized" should read --utilize--.
In column 8, line 29, "will desirable to utilized" should read --will be desirable to utilize--.
In column 8, line 41, "an non-visual" should read --a non-visual--.
In column 9, line 5, "included" should read --include--.
In column 9, line 47, "that that" should read --that--.
In column 10, line 13, "form" should read --from--.
In column 10, line 16, "dyes concentration" should read --dye concentration--.
In column 10, line 25, "weigh" should read --weight--.
In column 10, line 34, "and or" should read --and/or--.
In column 11, line 10, "pigmented dyes" should read --pigmented dyes,--.
In column 12, line 20, "can conveniently" should read --can be conveniently--.
In column 12, line 56, "Solvent" should read --Solvents--.
In column 12, line 64, "be utilize" should read --be utilized--.
In column 13, line 2, "form" should read --from--.
In column 13, line 10, "be use" should read --be used--.
In column 13, at the beginning of line 29, "lest" should read --less--.
In column 13, at the end of line 29, "encapsulated on" should read --encapsulated or--.
In column 13, line 41, "with temperature transition will" should read --with a temperature transition--.
In column 13, line 48, "form" should read --from--.

Signed and Sealed this
Nineteenth Day of August, 2014

Michelle K. Lee

Michelle K. Lee
*Deputy Director of the United States Patent and Trademark Office*

In the Specification (continued):

In column 14, line 54, “Research Crop.” should read --Research Corp.--.
In column 14, line 64, “under goes” should read --undergoes--.
In column 15, line 23, “color less” should read --colorless--.
In column 15, line 64, “between 70 and 75°” should read --between 70° and 75°--.
In column 16, at the end of line 40, “exist” should read --exists--.
In column 19, line 47, “Santa Ana Calif.” should read --Santa Ana, Calif.--
In column 19, line 47, “Lawrenceville Ga” should read -- Lawrenceville, GA--.
In column 19, line 63, “the effectively” should read --that effectively--.
In column 20, line 4, “and or” should read --and/or--.
In column 20, line 28, “CPFilms Crop.” should read --CPFilms Corp.--.
In column 20, line 44, “as on” should read --on--.
In column 20, line 47, “Adhesives coverings” should read --Adhesive coverings--.
In column 21, line 55, “on intended the” should read --on the intended--.
In column 21, line 59, “pigmented dyes” should read --pigmented dyes,--.
In column 21, line 66, second line to last from the bottom, “in to” should read --into--.
In column 23, line 1, “to and” should read --to a--.
In column 23, line 26, “Sender” should read --Seder--.
In column 26, line 52, “CPFilms Crop.” should read --CPFilms Corp.--.
In column 27, line 27, “wither” should read --either--.
In column 27, at the end of line 28, “pealing” should read --peeling--.
In column 27, line 64, “wither” should read --either--.
In column 27, at the end of line 66, second line to last from the bottom, “pealing” should read --peeling--.
In column 28, line 40, “wither” should read --either--.
In column 28, line 42, “pealing” should read --peeling--.
In column 28, line 60, “Day Glo Crop.” should read --Day Glo Corp.--.
In column 29, line 9, “wither” should read --either--.
In column 29, line 11, “pealing” should read --peeling--.
In column 29, line 46, “CPFilms Crop.” should read --CPFilms Corp.--.
In column 30, line 13, “wither” should read --either--.
In column 30, line 14, “pealing” should read --peeling--.
In column 30, line 46, “wither” should read --either--.
In column 30, line 48, “pealing” should read --peeling--.
In column 31, line 4, “gram” should read --grams--.
In column 31, line 58, “wither” should read --either--.
In column 32, line 4, “can be use” should read --can be used--.
In column 32, line 12, “form” should read --from--.
In column 34, line 60, “used register” should read --used to register--.
In column 36, line 11, “skill in the ort” should read --skill in the art--.
In column 36, at the beginning of line 22, “a reversers” should read --reversers--.